US006905395B2

(12) United States Patent
Walch

(10) Patent No.: US 6,905,395 B2
(45) Date of Patent: Jun. 14, 2005

(54) ABRASIVE FLOW MACHINING APPARATUS AND METHOD

(75) Inventor: William L. Walch, Greensburg, PA (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 10/488,527

(22) PCT Filed: Sep. 21, 2001

(86) PCT No.: PCT/US01/42242

§ 371 (c)(1),
(2), (4) Date: Aug. 16, 2004

(87) PCT Pub. No.: WO03/035325

PCT Pub. Date: May 1, 2003

(65) Prior Publication Data

US 2004/0266320 A1 Dec. 30, 2004

(51) Int. Cl.[7] ..... B24B 31/116

(52) U.S. Cl. ..... 451/36; 451/113

(58) Field of Search ..... 451/36, 37, 60, 451/61, 113, 430, 559, 1, 24, 27, 7

(56) References Cited

U.S. PATENT DOCUMENTS

| | | | | | |
|---|---|---|---|---|---|
| 3,634,973 | A | * | 1/1972 | McCarty | 451/36 |
| 3,823,514 | A | * | 7/1974 | Tsuchiya | 451/36 |
| 5,807,163 | A | * | 9/1998 | Perry | 451/36 |

FOREIGN PATENT DOCUMENTS

| | | | | |
|---|---|---|---|---|
| JP | 40-6031615 | * | 2/1994 | 451/36 |
| JP | 40-3196964 | * | 8/1994 | 451/36 |

* cited by examiner

*Primary Examiner*—Robert A. Rose
(74) *Attorney, Agent, or Firm*—The Webb Law Firm, P.C.

(57) ABSTRACT

An apparatus and method for abrasive flow machining the orifice (18) of a workpiece (20) by using an abrasive media (15) whereby the apparatus (10) is capable of passing media (15) through the orifice (18) at a predetermined pressure and at a constant flow rate. In the alternative, the apparatus (10) is capable of passing media (15) through the orifice (18) at a fixed flow rate by using variable pressure upon the media (15) through the orifice (18).

45 Claims, 5 Drawing Sheets

ABRASIVE FLOW MACHINING APPARATUS AND METHOD

BACKGROUND OF THE INVENTION

1. Field of the Invention

The invention is related to abrasive flow machining and, more particularly, to an abrasive flow machining apparatus capable of processing an orifice within a part by carefully controlling the media flow rate. The invention is also directed to a method for such processing.

2. Description of the Related Art

Abrasive flow machining is the process of polishing or abrading a workpiece by passing a viscous media having abrasive particles therein under pressure over the workpiece or through an orifice extending through the workpiece.

Conventional abrasive flow machining processes are designed to maintain a constant media extrusion pressure which often results in significant changes in media temperature, flow rate and viscosity which adversely impacts the system capability to accurately predict abrasive flow machine (AFM) processing times and, consequently, overall process results.

As an example, the media temperature increases as the flow rate of the media increases through an orifice. When the orifice is subjected to media under a constant pressure, the flow rate of the media through the orifice increases as the orifice walls becomes smoother and the orifice diameter increases. As a result, not only does the media temperature increase, but such an increase is localized to the media that passes through the orifice at a higher flow rate. This produces both excessively high temperatures and a non-uniform temperature distribution throughout the media. High temperatures and variations in temperatures throughout the media prevent the media from working in a consistent and effective fashion. Therefore, an apparatus and method that may effectively utilize the media while at the same time maintain the temperature of the media within a relatively narrow temperature band is desired.

U.S. Pat. No. 3,634,973, which is assigned to the assignee of the present invention, discloses a reciprocal machining structure utilizing abrasive media but operating in a fashion which does not provide for direct control of the media flow rate through an orifice. While this apparatus is capable of affective abrasive flow machining, such machining would be of a higher quality and the media would last longer if the flow rate were controlled.

BRIEF SUMMARY OF THE INVENTION

A first embodiment of the subject invention is directed to an abrasive flow machine for moving abrasive media through the orifice of a workpiece comprising a workpiece holder, wherein the holder is adapted to securely retain the workpiece, and wherein one side of the holder defines an upstream side and the other side of the holder defines a downstream side. A first positive displacement pump positioned on the upstream side and connected to the upstream side of the holder for forcing media under a predetermined pressure to the downstream side of the holder. A media opposer is positioned on the downstream side and connected to the downstream side of the holder for opposing the flow of the media to the downstream side, thereby controlling the media flow rate from the upstream side to the downstream side of the holder.

In a second embodiment of the subject invention, an abrasive flow machine for moving abrasive media through the orifice of a workpiece comprises a workpiece holder, wherein the holder is adapted to securely retain the workpiece, and wherein one side of the holder defines a first side and the other side of the holder defines a second side. A first positive displacement pump is positioned on the first side and connected to the first side of the holder and a second positive displacement pump positioned on the second side and connected to the second side of the holder. In a first mode the first positive displacement pump forces media from the first side to the second side of the holder while the second displacement pump resists flow thereby controlling flow to the second side of the holder. In a second mode the second positive displacement pump forces media from the second side to the first side of the holder while the first displacement pump resists flow thereby controlling flow to the first side of the holder.

A third embodiment of the subject invention is directed to a method for abrasive flow machining using an abrasive media through the orifice of a workpiece, wherein the orifice defines an upstream side and a downstream side. The method comprises the steps of moving media through the orifice from the upstream side to the downstream side at a predetermined constant pressure on a first side and selectively throttling the flow of media to the downstream side to control the flow rate of the media passing through the orifice while maintaining the predetermined constant pressure on a second side.

A fourth embodiment of the subject invention is directed to a method for abrasive flow machining using an abrasive media through the orifice of a workpiece, wherein the orifice defines a first side and a second side. The method comprises the steps of moving media through the orifice from the first side to the second side at a predetermined constant pressure selectively throttling the flow of media to the second side to control the flow rate of the media passing through the orifice while maintaining the predetermined constant pressure moving media through the orifice from the second side to the first side at the predetermined constant pressure and selectively throttling the flow of media to the first side to control the flow rate of the media passing through the orifice while maintaining the predetermined constant pressure.

A fifth embodiment of the subject invention is directed to a method for abrasive flow machining using an abrasive media through the orifice of a workpiece, wherein the orifice defines an upstream side and a downstream side, comprising the steps of moving media through the orifice from the upstream side to the downstream side at a pressure adjusting the pressure to provide a constant flow rate of the media passing through the orifice.

A sixth embodiment of the subject invention is directed to a method for abrasive flow machining using an abrasive media through the orifice of a workpiece, wherein the orifice defines a first side and a second side. The method comprises the steps of moving media through the orifice from the first side to the second side by applying pressure at the first side and relieving pressure at the second side, adjusting the pressure at the first side to provide a constant flow rate of the media passing from the first side through the orifice, moving media through the orifice from the second side to the first side by applying pressure at the second side and relieving pressure at the first side, and adjusting the pressure at the second side to provide a constant flow rate of the media passing from the second side through the orifice.

DETAILED DESCRIPTION OF THE INVENTION

In one embodiment of the subject invention abrasive media is subjected to a constant pressure and forced through an orifice of a workpiece. The flow rate discussed with this embodiment will be equal to or less than the maximum flow rate capability with the downstream side of the orifice open to the atmosphere. In particular, a flow rate of less than this maximum value is obtained by limiting the flow of the media at the down stream side of the orifice.

Figure 1:
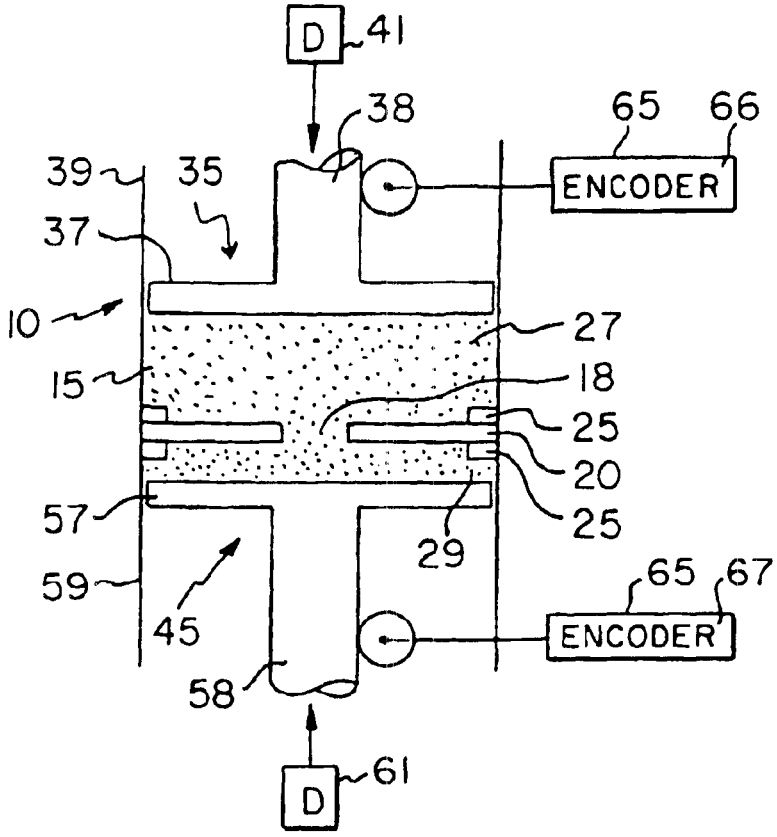
FIG. 1 is a simplified sketch illustrating two opposing positive displacement pumps urging abrasive media through the orifice of a workpiece.

Directing attention to FIG. 1, a simplified schematic of an abrasive flow machine 10 for moving abrasive media 15 through the orifice 18 of a workpiece 20 is illustrated. For purposes of this discussion, media will be discussed as having viscosity in the range between 1 to 50 million centipoise. One example of a relatively high viscosity media is a visco-elastic plastic media such as a semisolid polymer composition. One example of a media having a lower viscosity is a liquid abrasive slurry that includes abrasives suspended or slurried in fluid media such as cutting fluids of honing fluids. The fluid may have a rheological additive, and finely divided abrasive particles incorporated therein. The rheological additive creates a thixotropic slurry. The abrasive flow machine 10, as an entity on its own, will not include the workpiece 20 having the orifice 18 therein but will include a workpiece holder 25 which is adapted to securely retain the workpiece 20 wherein one side 27 of the holder 25 defines an upstream or first side and the other side 29 of the holder 25 defines a downstream or second side.

A first positive displacement pump 35 is positioned on the upstream side 27 and connected to the upstream side 27 of the holder 25 for forcing media 15 under a predetermined pressure through the orifice 18 of the workpiece 20 to the downstream side 29 of the holder 25.

Unencumbered flow of the media through the orifice 18 is prevented by a media opposer 45 positioned on the downstream side 29 of the holder 25 for opposing the flow of the media 15 to the downstream side 29, thereby controlling the media flow rate from the upstream side 27 to the downstream side 29 of the holder 25.

Figure 3:
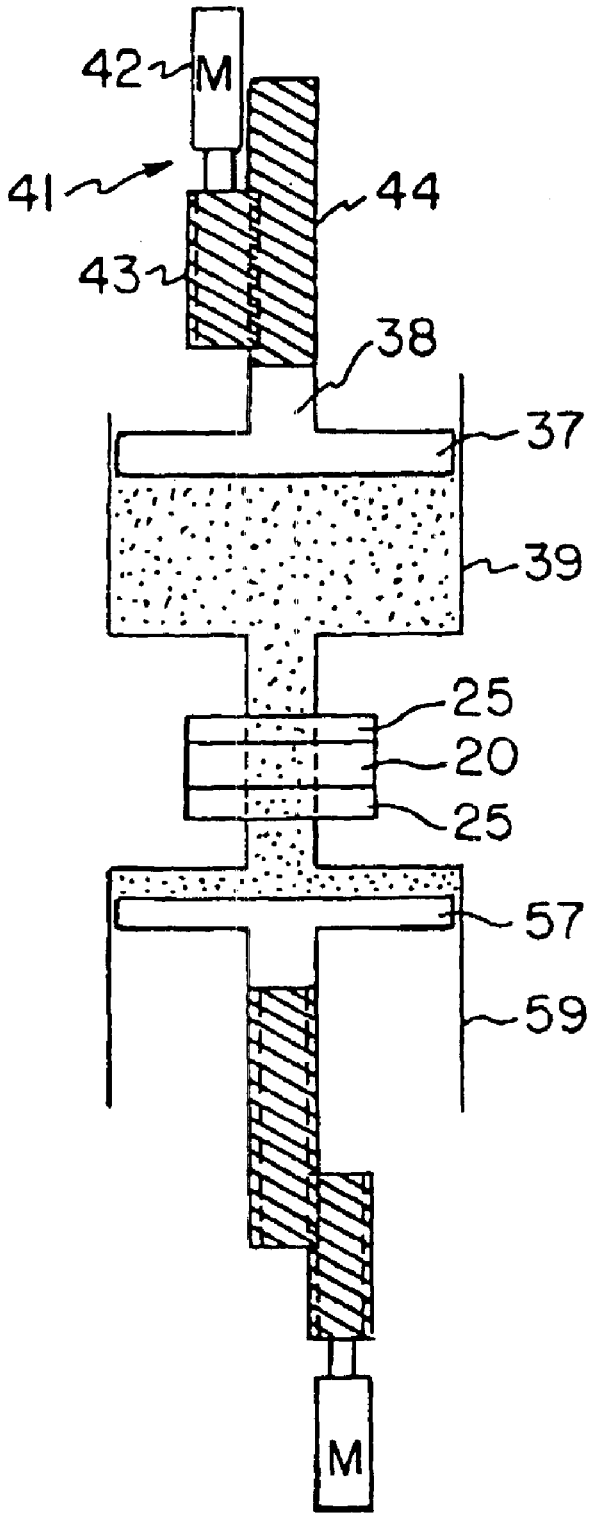
FIG. 3 illustrates opposing positive displacement pumps for moving media back and forth through an orifice whereby the drivers of the pumps are linear actuators.

As illustrated in FIG. 1, the first positive displacement pump 35 is comprised of a piston 37 within a cylinder 39, wherein the piston 37 is operable to urge media 15 from the cylinder 39 toward the downstream side 29 of the holder 25. The piston 37 is moved by a driver 41. As will be illustrated, the driver 41 for the piston 37 may be a hydraulic actuator (FIG. 4) or as illustrated in FIG. 3, the driver 41 may be a linear motor actuator 42 which utilizes for example, a worm gear 43 which engages a mating gear 44 on a rod 38 extending from the piston 37. It should be appreciated that while only two types of drivers have been mentioned, any number of drivers known to those skilled in the art of hydraulic machinery may be utilized for the positive displacement pumps in accordance with the subject invention.

Returning to FIG. 1, one method to control both the pressure of the media 15 and the flow rate of the media 15 involves reducing the flow rate through the orifice 18 by restricting the amount of media permitted to travel to the downstream side 29 of the holder 25. In particular, a second positive displacement pump 55 may be utilized as the media opposer 45 to accomplish this. The second positive displacement pump 55 has a piston 57 within a cylinder 59. The piston 57 is operable to resist and thereby control the media flow to the downstream side 29 of the holder 25.

Other mechanisms are available to act as a media opposer 45. Directing attention to FIG. 2, an arrangement similar to that in FIG. 1 is presented, however, the media opposer 45 now takes the form of a relief valve 60. The media 15 flows directly through the relief valve 60 and the release pressure of the relief valve 60 is controlled based upon the desired media flow rate.

In a preferred embodiment, the relief valve 60 is a proportional electric relief valve (PER). A control device monitors the flow rate and decreases a voltage output to the proportional electric relief valve 60 when the actual flow rate is greater than a target flow rate. This causes the relief valve 60 to allow less media 15 to pass through. In the alternative, the voltage output to the valve 60 may be increased which allows more media 15 to pass through when the actual flow rate is less than a target flow rate. Other relief valves described herein may operate in a similar fashion.

To accurately determine the media flow rate, a media flow rate measurement device 65 is utilized. One such device is illustrated in FIG. 1. When the first positive displacement pump 35 is comprised of a piston 37 within a cylinder 39, the piston 37 may have a rod 38. An encoder 66 may be used as the flow rate measurement device 65 to measure the linear motion of the rod 38 to determine the media flow rate. Knowing the volume within the cylinder 39, and the rate of travel of the piston 37, which is provided by the encoder 66, the volume flow rate of the media 15 through the orifice 18 may be used to determine the media flow rate and in turn the controller may adjust the media opposer 45 to increase or decrease the flow rate of the media 15 through the orifice 18.

When the media opposer 45 is comprised of the second positive displacement pump 55, which as previously discussed has a piston 57 within a cylinder 59, the piston 57 has a rod 58 and under such circumstances the media flow measurement device 65 may be an encoder 67 that measures the linear motion of the rod 58 to determine the media flow rate. It should be apparent therefore that the measurement of the media flow rate may occur at either the upstream side 27 or downstream side 29 of the holder 25.

Encoders 66, 67 may each be either a linear encoder or a rotary encoder, both of which are well known to those skilled in the field of measurement equipment.

The discussion so far has been limited to flow of media 15 in a single direction from the upstream side 27 of the holder 25 to the downstream side 29 of the holder 25. In the abrasive flow machine 10 embodiment illustrated in FIG. 2, this is the only manner in which the media 15 may flow through the orifice 18 of the workpiece 20. However, as illustrated in FIG. 1, when the media opposer 45 is a second positive displacement pump 55, the roles of the first displacement pump 35 and second displacement pump 55 may alternate such that in a first mode the first displacement pump 35 may force media 15 through the orifice 18 while the second positive displacement pump 55 acts as the media opposer 45 to control the flow rate of the media 15. In a second mode of operation, the second positive displacement pump 55 may be used to force the media 15 toward the first positive displacement pump 35 while the first positive displacement pump 35 is used as a media opposer to control flow in the opposite direction. It is apparent from this description that with these alternating modes media 15 may be moved back and forth through the orifice 18 in a reciprocating fashion.

Directing attention once again to FIG. 1, each of the first positive displacement pump 35 and the second positive displacement pump 55 are comprised of pistons 37, 57 within cylinders 39, 59 wherein the pistons 37, 57 are moved by drivers 41, 61. Just as before, each driver 41, 61 may be a hydraulic actuator, which will be described or in the alternative, may be a linear motor actuator as illustrated in FIG. 3.

When the abrasive flow machine 10 is operating such that media 15 is moved only in a single direction through the orifice 18 of the workpiece 20, the media 15 is moved through the orifice 18 from the upstream side 27 to the downstream side 29 at a predetermined constant pressure. The flow of media 15 to the downstream side 29 is then selectively throttled to control the flow rate of the media 15 passing through the orifice 18 while at the same time maintaining the predetermined constant pressure.

In an alternative embodiment when the abrasive flow machine 10 is utilized in a reciprocating fashion, media 15 is moved through the orifice 18 from the upstream side 27, which is now referred to as the first side 27, to the downstream side 29, which is now referred to as the second side 29, at a predetermined constant pressure. The flow of media 15 to the second side 29 is selectively throttled to control the flow rate of the media 15 passing through the orifice 18 while maintaining the predetermined constant pressure. Thereafter, the media 15 is moved through the orifice 18 from the second side 29 to the first side 27 at a predetermined constant pressure. However, the flow of media 15 to the first side 27 is now selectively throttled to control the flow rate of the media 15 passing through the orifice 18 while maintaining the predetermined constant pressure. Just as before, the amount the media selectively throttled is determined by the media flow rate through the orifice 18, and this is determined by monitoring the flow rate utilizing one or both of the linear encoders 66, 67.

Figure 4:
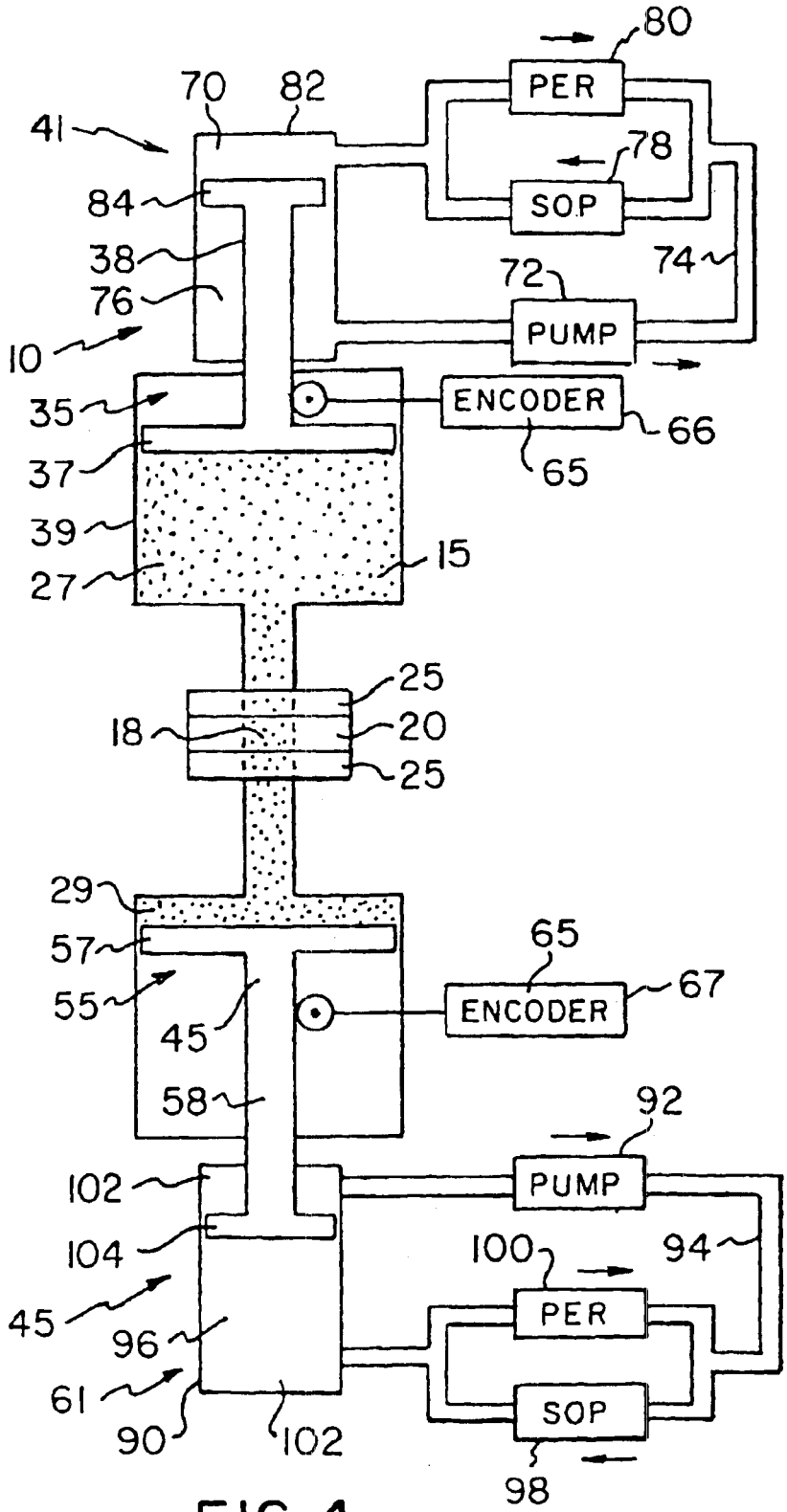
FIG. 4 is a simplified sketch of two opposing positive displacement pumps and the control systems which operate them.

FIG. 4 illustrates a more comprehensive schematic view of the abrasive flow machine 10, wherein each positive displacement pumps 35, 55 has a driver 41, 61 and each driver 41, 61 may be a hydraulic actuator.

In particular, FIG. 4 includes many elements previously discussed, and the reference numbers for these elements will be retained. However, additional details associated with the driver 41 and the driver 61 in conjunction with the operation of the abrasive flow machine 10 will now be discussed.

In the single stroke mode, whereby the first positive displacement pump 35 moves media 15 through the orifice 18 of the workpiece 20 to the media opposer 45, which is the second positive displacement pump 55, the driver 41 acts to force the media 15 through the orifice 18 while the driver 61 acts as a media opposer 45 to resist and control such flow. Directing attention to the hydraulic actuator 70 associated with driver 41, a hydraulic pump 72 moves media through a supply line 74 at which point the hydraulic fluid 76 encounters a poppet valve 78, which may be a solenoid operated poppet valve (SOP), which for purposes of our discussion is a valve which permits full flow or no flow. The hydraulic fluid 76 also encounters a proportional electric relief valve 80, which as previously mentioned is capable of adjusting its resistance to flow therethrough. When the hydraulic actuator 70 is being used as a driver 41, the poppet valve 78 is in the full open position and the relief valve 80 is completely closed. Therefore, the hydraulic cylinder 82 is pressurized with hydraulic fluid 76 at whatever pressure the pump 72 can provide. This may be a predetermined pressure that remains constant throughout the stroke of the first positive displacement pump 35. A piston 84 in the hydraulic cylinder 82 is acted upon by the pressurized hydraulic fluid 76 such that, through the common piston rod 38, the piston 37 is advanced against the media 15, thereby forcing the media 15 through the orifice 18 of the workpiece 20.

When the first positive displacement pump 35, with the hydraulic actuator 70, acts as a driver 41, the second positive displacement pump 55, with the hydraulic actuator 90, acts as a media opposer 45. In particular, the hydraulic actuator 90 has similar components to the hydraulic actuator 70 including a hydraulic pump 92, supply line 94, and hydraulic fluid 96, wherein the hydraulic fluid is directed to a poppet valve 98 and a relief valve 100. The hydraulic actuator 90 is further comprised of a hydraulic cylinder 102 having a piston 104 therein connected to the piston rod 58 of the positive displacement pump 55. When the driver 41 urges media 15 through the orifice 18 media 15 is also urged against the piston 57, thereby transferring a force to the piston 104 which acts against the hydraulic fluid 96 in the hydraulic actuator 90. When the second positive displacement pump 55 acts as a media opposer 45 the poppet valve 98 is completely closed such that the hydraulic fluid 96 must pass through the relief valve 100.

It should be noted in FIG. 4 that a single pump utilizing directional valves and a hydraulic fluid reservoir may be used in lieu of the two pumps 72, 92.

The media flow rate through the orifice 18 is determined by one of the encoders 66, 67 and transmitted to a controller. Utilizing the media flow rate, and comparing it to a target media flow rate, the voltage in the proportional electric relief valve 100 is adjusted to permit hydraulic fluid 96 past the relief valve 100 in such a manner that the retraction of the piston 104 is controlled, thereby controlling the media flow rate. In this manner, when the first positive displacement pump 35 acts as the driver 41, the poppet valve 78 associated with the hydraulic actuator 70 is fully opened thereby bypassing the relief valve 80. With respect to the hydraulic actuator 90 of the second positive displacement pump 55, the poppet valve 78 is fully closed thereby forcing hydraulic fluid 96 through the relief valve 100, which throttles the hydraulic fluid flow to control the media flow rate.

In the second mode the same configuration exists, but in a reversed arrangement. In particular, when the second positive displacement pump 55 acts as a driver 61, the first positive displacement pump 35 acts as a media opposer. In particular, in this configuration the poppet valve 98 is fully opened such that the full pressure produced upon the hydraulic fluid 96 by the pump 92 is transferred to the piston 104, which in turn acts upon the piston 57 through the piston rod 58 and forces the media 15 through the orifice 18 toward the first positive displacement pump 35. Acting as a media opposer, the hydraulic actuator 70 is configured such that the poppet valve 78 is fully closed thereby forcing the hydraulic fluid 76 through the relief valve 80. The release pressure of the relief valve 80 may be electronically controlled by the controller based upon the media flow rate determined by one of the encoders 66, 67. In this fashion, the operation of the abrasive flow machine may be alternated between the first mode and the second mode to provide a reciprocating motion of the media 15 through the orifice 18 of the workpiece 20.

Figure 5:
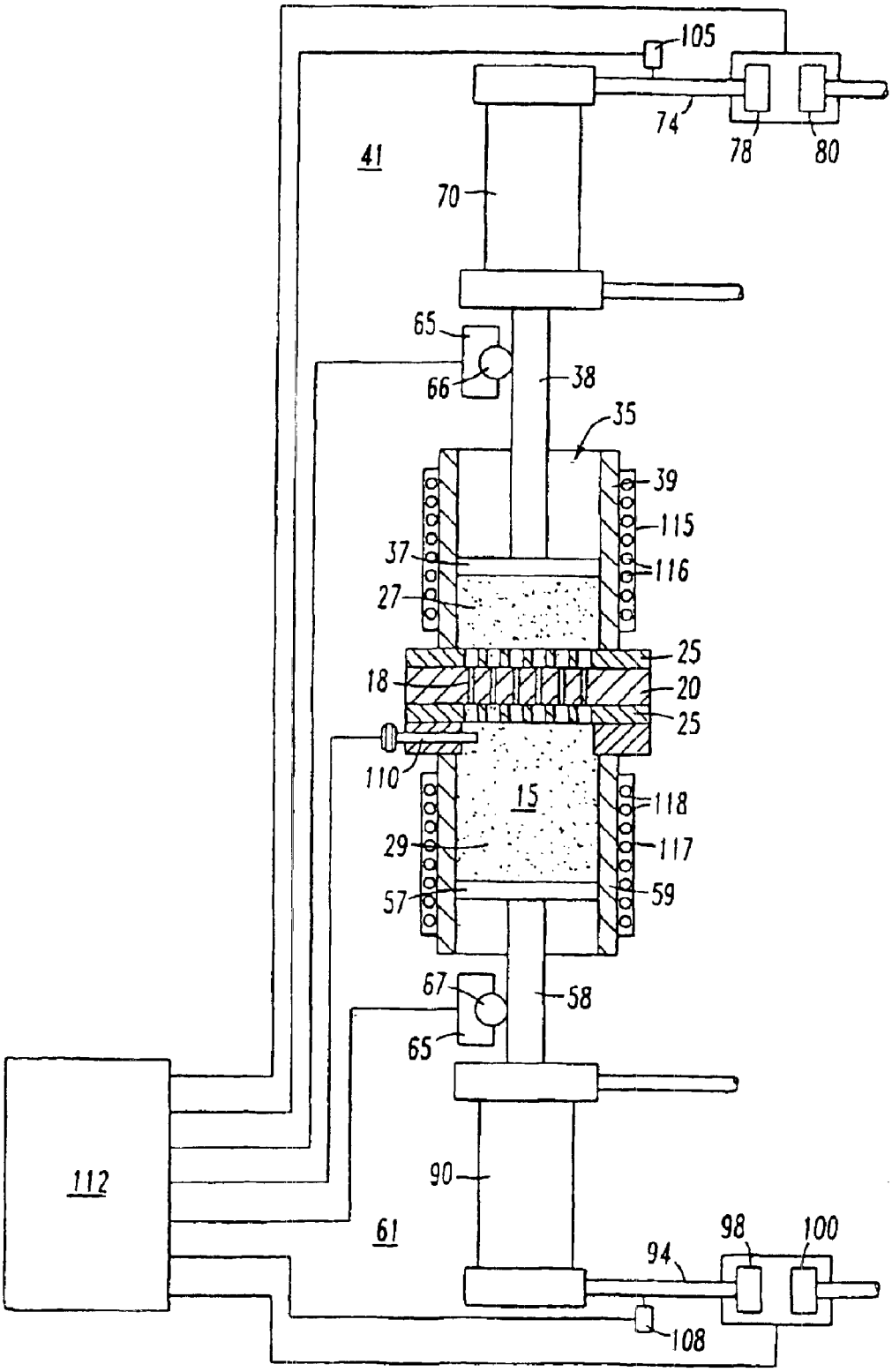
FIG. 5 is a sketch of an operating system illustrating two opposing positive displacement pumps and the associated hardware.

FIG. 5 represents a sketch of the hardware utilized to implement at least one embodiment of the subject invention described hereto. Just as before, like reference numerals are repeated. However, some additional elements are illustrated in this drawing. In particular, there is a pressure sensor 105 in the form of a pressure transducer associated with the hydraulic supply line 74 to determine the pressure in that line. Additionally, there is a pressure sensor 108 associated with supply line 94 to determine pressure in that line. It should be appreciated the pressure in the supply lines 74, 94 will be transmitted to the media 15 by the respective pistons 37, 57. Additionally, a temperature sensor 110 may be utilized to determine the temperature of the media 15.

The pressure of the hydraulic fluid, which translates into the pressure of the media 15, along with the linear position of each piston 37, 57 is processed by a controller 112 which in turn acts to modify the release pressure of the pressure relief valve 80 for the positive displacement pump acting as the media opposer.

By more closely controlling the flow rate of the media 15 through the orifice 18, the temperature may be held within a relatively narrow temperature band in contrast to when the flow rate is not controlled. Nevertheless, it may still be desirable to remove heat from the media 15 during the abrasive flow machining process. For that reason there may be a cooling collar 115 associated with the first positive displacement pump cylinder 39 and a cooling collar 117 associated with the second positive displacement pump cylinder 59. Each of these cooling collars 115, 117 may have a plurality of cooling tubes 116, 118 capable of transferring heat from the media 15 when necessary. Under certain circumstances these cooling collars 115, 117 may also be utilized to heat the media 15 such as, for example, when the media 15 must begin the abrasive process at a minimum temperature. The cooling collars 115, 117 are externally positioned and do not interfere with the flow of media 15. However, their effectiveness is limited because heat transfers from the media 15 to the collars 115, 117 occurs by conduction through the walls of the cylinders 39, 59.

Figure 7:
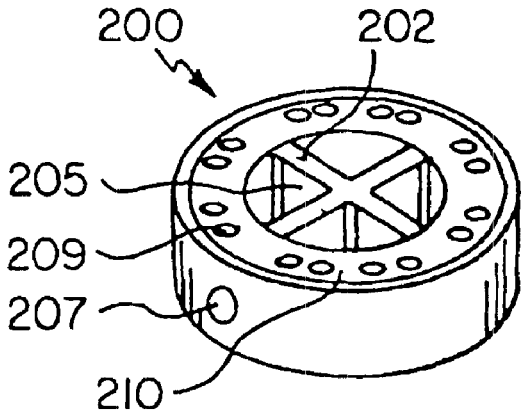
FIG. 7 is a perspective view of an in-line heat exchanger that may be used to control the temperature of the media.
Figure 1:
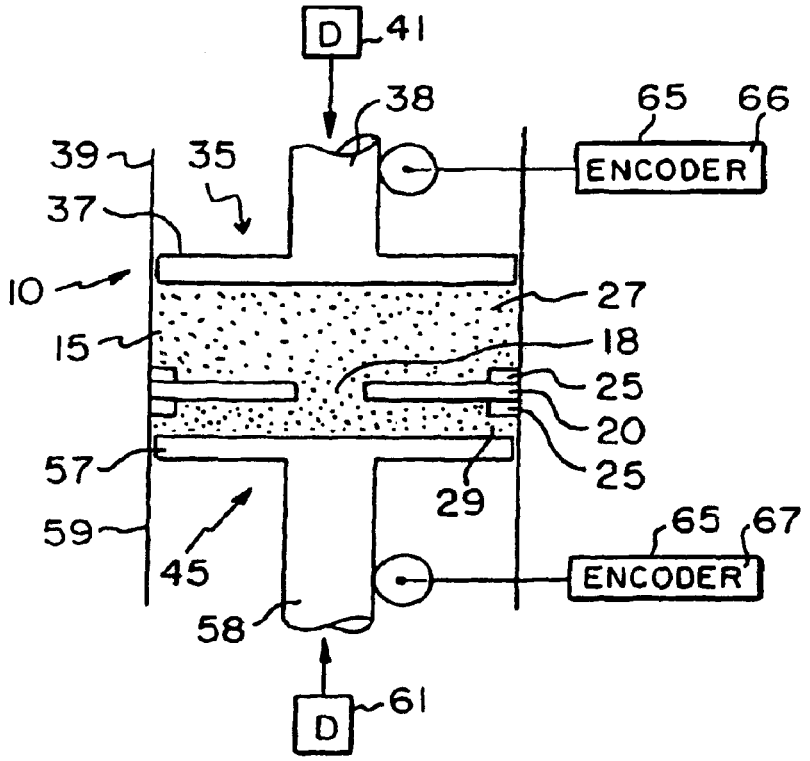
Figure 2:
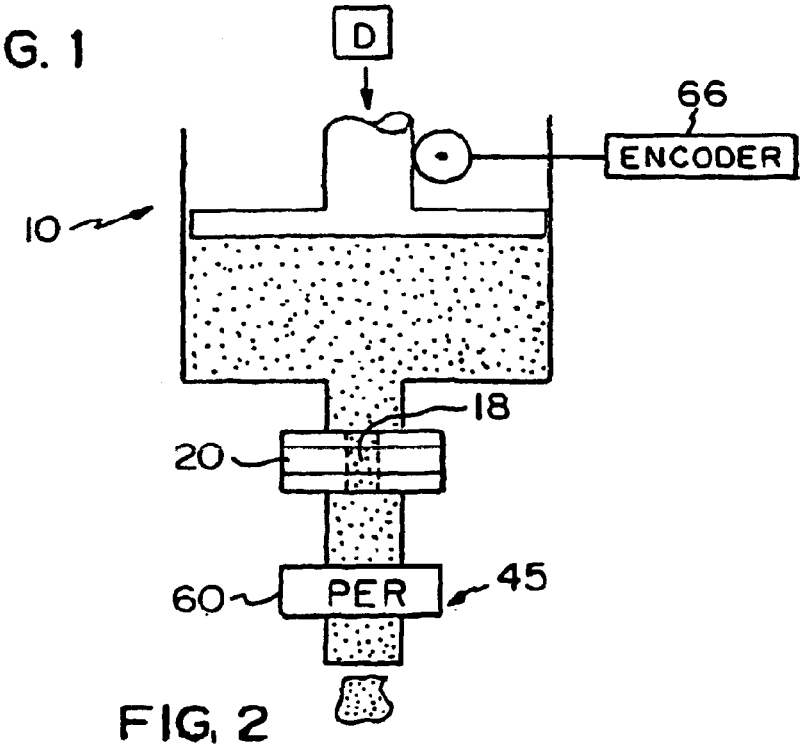
Figure 3:
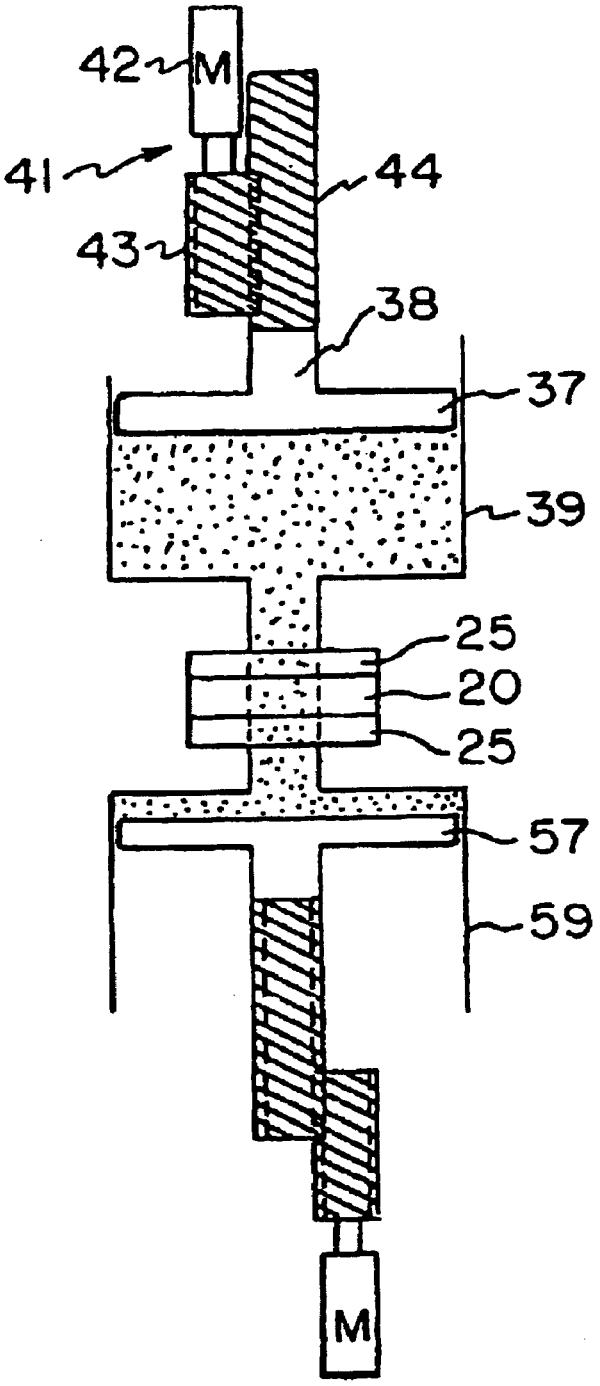
Figure 4:
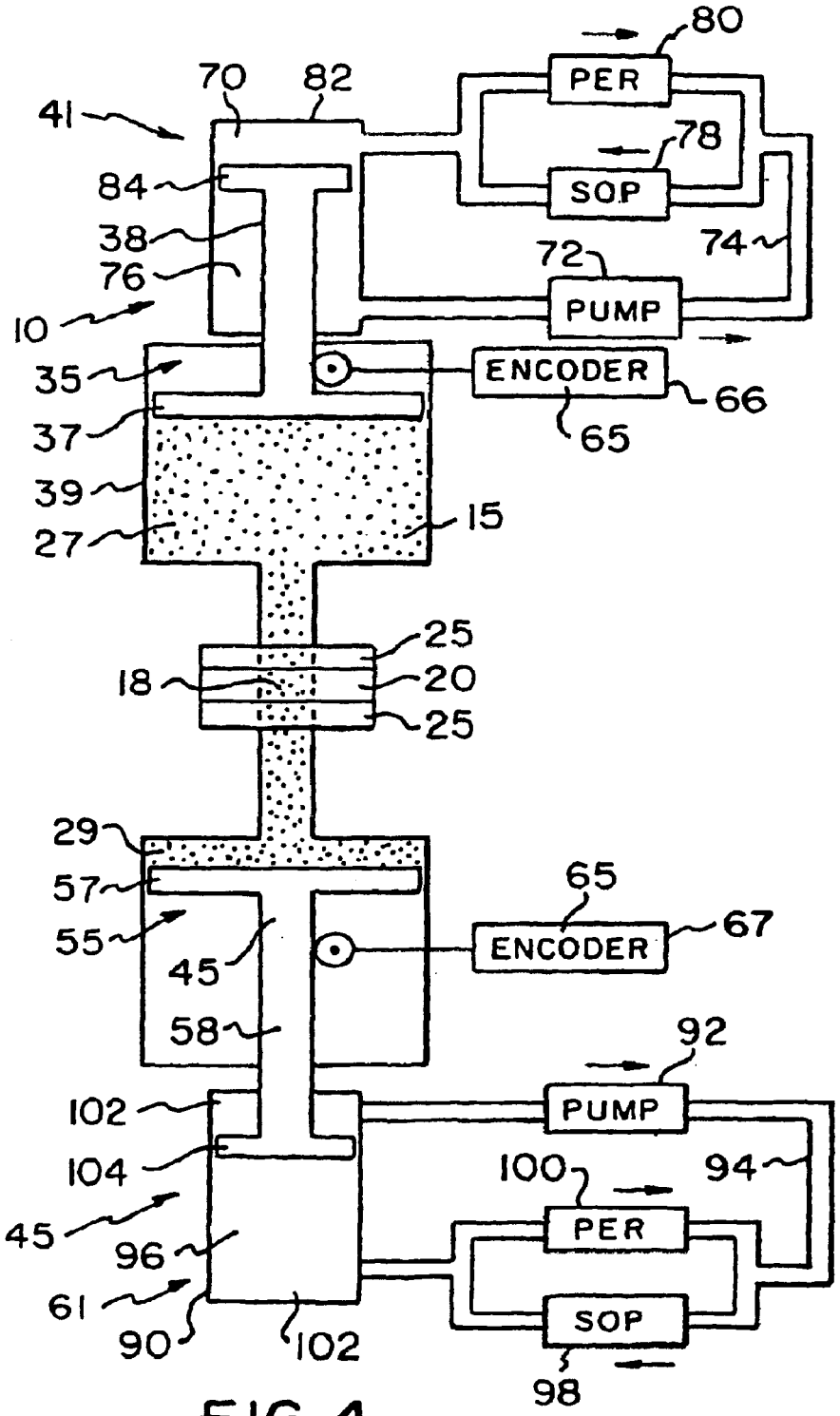
Figure 5:
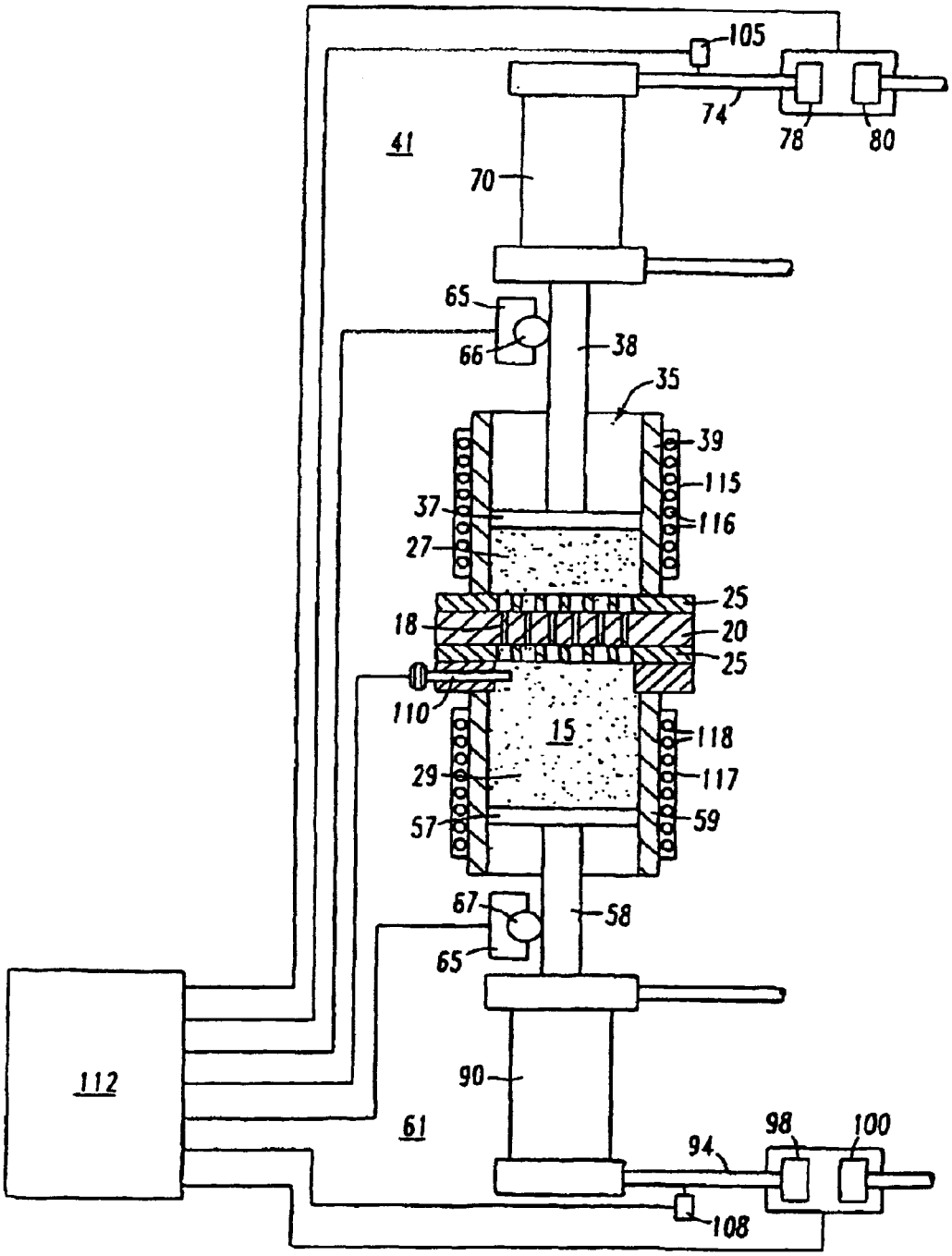
Figure 6:
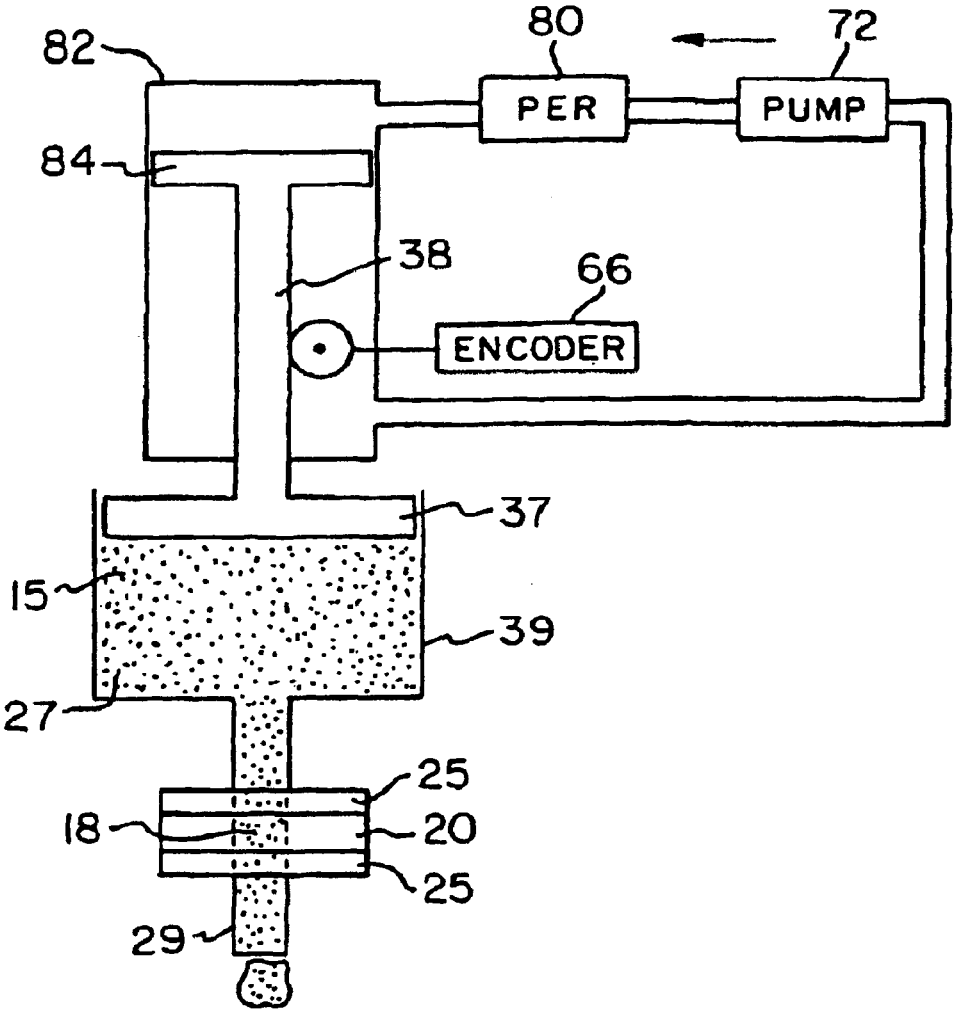
Figure 7:
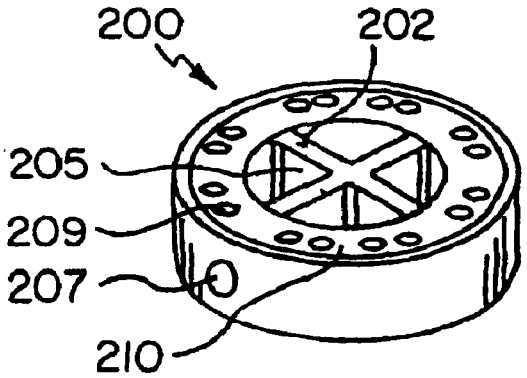

It is possible to introduce an in-line heat exchanger directly within the flow path of the media 15. FIG. 7 illustrates one such heat exchanger 200 having hollow cooling fins 202 within an internal passageway 205 through which the media 15 flows. Coolant passes through a coolant inlet 207, enters the hollow fins 202 and exits at the coolant outlet (not shown). Bolts may extend through peripheral holes 209 in the collar 210 to secure the heat exchanger 200. The heat exchanger 200 may be attached to one or both cylinders 39, 59 and may be adjacent to the holder 25. While this heat exchanger 200 provides a greater heat transfer rate with the media 15, it also partially obstructs the flow of media 15 such that the cylinder size may need to be increased to accommodate a given flow rate.

The controller 112 (FIG. 5) may be a programmable logic controller such as the Micologics 1200 model, which is commercially available from the Allen Bradley Company. Additionally, the proportional electric relief valve may be type TS 10–26, which is commercially available from Hydra Force, Inc. Additionally, the poppet valves may be type SV 10–23 two way normally open valves commercially available from Hydro Force, Inc.

The signals from the encoders 66, 67 are used by the controller 112 to calculate the actual flow rate of the media 15. A suitable encoder is the Quadrature type, which is commercially available from Automation Direct, Inc. The use of the encoders 66, 67 and the poppet valves 78, 98 and the relief valves 80, 100 allow the controller 112 to maintain a desired consistent media flow rate. This consistent flow rate allows the media to remain within a narrow temperature band, as measured by the temperature sensor 110, which in turn maintains consistent media viscosity. By maintaining the media viscosity essentially constant, the controller 112 may more accurately predict the processing time to achieve the desired machining of the orifice 18.

What has so far been described are drivers 41, 61 which alternately urge media 15 under constant pressure through the orifice 18 of the workpiece 20 while the flow rate of the media 15 is controlled by the retraction or resistance of the media opposer 50 which may be a pressure relief valve or the other driver.

It is possible to eliminate the media opposer 45 and still maintain a constant media flow rate. This is accomplished by varying the pressure provided by the driver 41 to the media 15. As the abrasive flow machining process proceeds, given a constant media pressure, the flow rate of the media 15 through the orifice 18 tends to increase. Therefore, to maintain the same media flow rate, it is necessary to decrease the pressure imparted to the media 15 by the driver 41. This may be accomplished in a single direction, or just as before, in a reciprocating motion.

Figure 6:
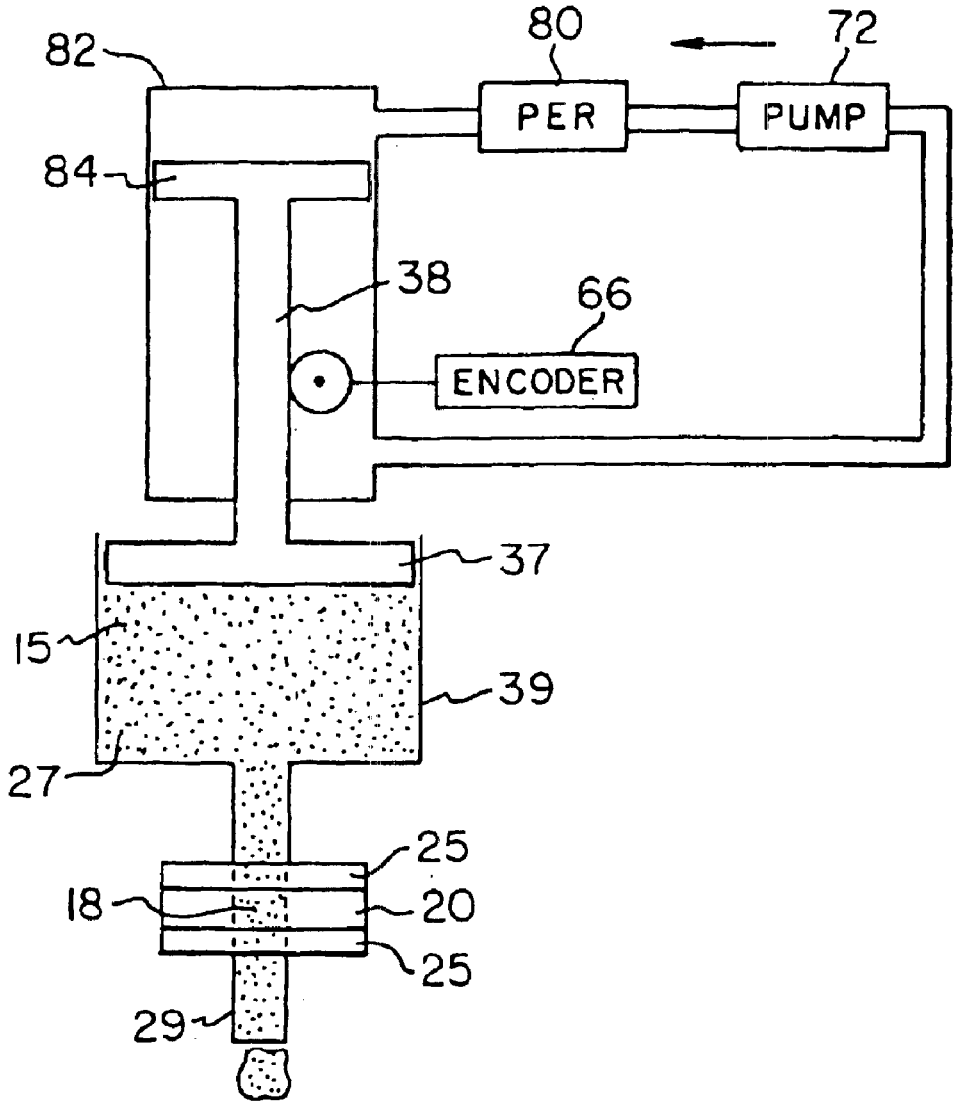
FIG. 6 is a simplified sketch of a single positive displacement pump which provides media through an orifice whereby the media is released to an open environment.

Directing attention to FIG. 6, in a single direction media 15 is moved through the orifice 18 from the upstream side 27 to the downstream side 29 at a particular pressure. Utilizing encoder 66 the flow rate may be monitored and the pressure provided to the media may be adjusted to provide a constant flow rate of the media 15 passing through the orifice 18. In particular, the encoder 66 may monitor the linear motion of the piston rod 38 associated with piston 37 to determine the flow rate. The pump 72 delivers hydraulic fluid under pressure to the hydraulic cylinder 82, where the fluid acts upon the hydraulic piston 84. With respect to the arrangement illustrated in FIG. 4, it is entirely possible for the downstream side 29 of the holder 25 to discharge into the atmosphere as illustrated in FIG. 6. In the alternative, and again directing attention to FIG. 4, it is possible to coordinate the motion of piston 37 with that of piston 57 such that the flow of media 15 applied under pressure at the first side 27 through the orifice 18 is neither hindered nor assisted by piston 57 but that pressure on the second side 29 side is relieved. It is also possible to coordinate the motion of piston 57 with that of piston 37 such that the flow of media 15 applied under pressure at the second side 57 through the orifice 18 is neither hindered nor assisted by piston 37 but that pressure on the first side 37 is relieved. Such an arrangement will permit the abrasive flow machine 10 illustrated in FIG. 4 to operate in a reciprocating fashion whereby in a first mode that the first positive displacement pump 35 forces the media 15 though the orifice 18 while the second positive displacement pump 55 is passive, and in the second mode the second positive displacement pump 55 forces the media 15 through the orifice 18 while the first positive displacement 35 is passive.

The invention has been described with reference to the preferred embodiments. Various modifications and alterations will occur upon reading and understanding the preceding detailed description. It is intended that the invention be construed as including all such modifications and alterations insofar as they come within the scope of the appended claims or the equivalents thereof.

I claim:

1. An abrasive flow machine for moving abrasive media through the orifice of a workpiece comprising:

a) a workpiece holder, wherein the holder is adapted to securely retain the workpiece, and wherein one side of the holder defines an upstream side and the other side of the holder defines a downstream side;

b) a first positive displacement pump positioned on the upstream side and connected to the upstream side of the holder for forcing media under a predetermined pressure to the downstream side of the holder; and c) a media opposer positioned on the downstream side and connected to the downstream side of the holder for opposing the flow of the media to the downstream side, thereby controlling the media flow rate from the upstream side to the downstream side of the holder.

2. The flow machine according to claim 1 wherein the first positive displacement pump is a piston within a cylinder, wherein the piston is operable to urge media from the cylinder toward the downstream side of the holder and wherein the piston is moved by a driver.

3. The flow machine according to claim 2 wherein the driver is a hydraulic actuator.

4. The flow machine according to claim 2 wherein the driver is a linear motor actuator.

5. The flow machine according to claim 1 wherein the media opposer is a relief valve.

6. The flow machine according to claim 5 wherein the media opposer is a proportional electric relief valve.

7. The flow machine according to claim 1 wherein the media opposer is a second positive displacement pump.

8. The flow machine according to claim 7 wherein the second positive displacement pump is a piston within a cylinder, wherein the piston is operable to resist and thereby control the media flow to the downstream side of the holder.

9. The flow machine according to claim 1 further including a media flow rate measurement device to determine the flow rate of media past the holder.

10. The flow machine according to claim 9 wherein the first positive displacement pump is comprised of a piston within a cylinder, wherein the piston has a rod and wherein an encoder measures the linear motion of the rod to determine the media flow rate.

11. The flow machine according to claim 9 wherein the media opposer is a second positive displacement pump comprised of a piston within a cylinder, wherein the piston has a rod and wherein the media flow rate measurement device is an encoder that measures the linear motion of the rod to determine the media flow rate.

12. The flow machine according to claim 1 further including a cooler for the media.

13. The flow machine according to claim 12 wherein the cooler is comprised of cooling collars around at least one of the first positive displacement pump cylinder and the second positive displacement pump cylinder.

14. The flow machine according to claim 12 wherein the cooler is comprised of an in-line heat exchanger adjacent to the holder in at least one of the first displacement pump cylinder and the second displacement pump cylinder.

15. An abrasive flow machine for moving abrasive media through the orifice of a workpiece comprising:

a) a workpiece holder, wherein the holder is adapted to securely retain the workpiece, and wherein one side of the holder defines a first side and the other side of the holder defines a second side;

b) a first positive displacement pump positioned on the first side and connected to the first side of the holder;

c) a second positive displacement pump positioned on the second side and connected to the second side of the holder;

d) wherein in a first mode the first positive displacement pump forces media from the first side to the second side of the holder while the second displacement pump resists flow thereby controlling flow to the second side of the holder; and e) wherein in a second mode the second positive displacement pump forces media from the second side to the first side of the holder while the first displacement pump resists flow thereby controlling flow to the first side of the holder.

16. The abrasive flow machine according to claim 15 wherein the each the first and second positive displacement pumps are comprised of pistons within cylinder wherein the pistons are moved by drivers.

17. The flow machine according to claim 16 wherein at least one driver is a hydraulic actuator.

18. The flow machine according to claim 16 wherein at least one driver is a linear motor actuator.

19. The flow machine according to claim 15 further including a media flow rate measurement device to determine the flow rate of media past the holder.

20. The flow machine according to claim 19 wherein the each of the first positive displacement pump and the second displacement pump have a rod associated within their respective pistons and wherein the media flow rate measurement device is an encoder that measures the linear motion of at least one rod to determine the media flow rate.

21. The flow machine according to claim 15 further including a cooler for the media.

22. The flow machine according to claim 21 wherein the cooler is comprised of cooling collars around at least one of the first positive displacement pump cylinder and the second positive displacement pump cylinder.

23. The flow machine according to claim 21 wherein the cooler is comprised of an in-line heat exchanger adjacent to the holder in at least one of the first displacement pump and the second displacement pump cylinders.

24. A method for abrasive flow machining using an abrasive media through the orifice of a workpiece, wherein the orifice defines an upstream side and a downstream side, comprising the steps of:

a) moving media through the orifice from the upstream side to the downstream side at a predetermined constant pressure on a first side; and b) selectively throttling the flow of media to the downstream side to control the flow rate of the media passing through the orifice while maintaining the predetermined constant pressure on a second side.

25. The method according to claim 24 further including the step of monitoring the flow rate.

26. The method according to claim 25 wherein media is forced through the orifice using a first positive displacement pump comprised of a piston with a piston rod wherein the piston is within a cylinder and moved by a driver connected to the piston and wherein the step monitoring flow rate is accomplished by monitoring the linear movement of the piston rod.

27. The method according to claim 24 further comprising the step of restricting the media flow downstream to control the media flow rate.

28. The method according to claim 27 wherein the step of throttling is accomplished using a proportional electric relief valve to resist downstream flow of the media.

29. The method according to claim 27 wherein the step of throttling is accomplished using a second positive displacement pump to resist downstream flow of the media.

30. The method according to claim 24 further including the step of cooling the media.

31. A method for abrasive flow machining using an abrasive media through the orifice of a workpiece, wherein the orifice defines a first side and a second side, comprising the steps of:

a) moving media through the orifice from the first side to the second side at a predetermined constant pressure;

b) selectively throttling the flow of media to the second side to control the flow rate of the media passing through the orifice while maintaining the predetermined constant pressure;

c) moving media through the orifice from the second side to the first side at the predetermined constant pressure; and d) selectively throttling the flow of media to the first side to control the flow rate of the media passing through the orifice while maintaining the predetermined constant pressure.

32. The method according to claim 31 further including the step of monitoring the flow rate.

33. The method according to claim 32 wherein media is forced in one direction through the orifice using a first positive displacement pump comprised of a piston within a cylinder, wherein the piston has a piston rod and wherein the step monitoring the flow rate is accomplished by monitoring the linear movement of the piston rod.

34. The method according to claim 31 wherein the step of throttling is accomplished using a proportional electric relief valve to resist flow of the media from the first side to the second side.

35. The method according to claim 31 wherein the step of throttling is accomplished using a second positive displacement pump to resist flow of the media from the first side to the second side.

36. The method according to claim 31 further including the step of cooling the media.

37. A method for abrasive flow machining using an abrasive media through the orifice of a workpiece, wherein the orifice defines an upstream side and a downstream side, comprising the steps of:

a) moving media through the orifice from the upstream side to the downstream side at a pressure; and b) adjusting the pressure to provide a constant flow rate of the media passing through the orifice.

38. The method according to claim 37 further including the step of monitoring the flow rate.

39. The method according to claim 38 wherein media is forced through the orifice using a first positive displacement pump comprised of a piston with a piston rod wherein the piston is within a cylinder and moved by a driver connected to the piston and wherein the step monitoring flow rate is accomplished by monitoring the linear movement of the piston rod.

40. The method according to claim 37 further including the step of cooling the media.

41. A method for abrasive flow machining using an abrasive media through the orifice of a workpiece, wherein the orifice defines a first side and a second side, comprising the steps of:

a) moving media through the orifice from the first side to the second side by applying pressure at a first side and relieving pressure at the second side;

b) adjusting the pressure at the first side to provide a constant flow rate of the media passing from the first side through the orifice;

c) moving media through the orifice from the second side to the first side by applying pressure at the second side and relieving pressure at the first side; and d) adjusting the pressure at the second side to provide a constant flow rate of the media passing from the second side through the orifice.

42. The method according to claim 41 further including the step of monitoring the flow rate.

43. The method according to claim 42 wherein media is forced in one direction through the orifice using a first positive displacement pump comprised of a piston within a cylinder, wherein the piston has a piston rod and wherein the step monitoring the flow rate is accomplished by monitoring the linear movement of the piston rod.

44. The method according to claim 41 wherein the step of throttling is accomplished using a second positive displacement pump to resist flow of the media from the first side to the second side.

45. The method according to claim 41 further including the step of cooling the media. The invention has been described with reference to the preferred embodiment.

* * * * *

UNITED STATES PATENT AND TRADEMARK OFFICE

CERTIFICATE OF CORRECTION

PATENT NO. : 6,905,395 B2
DATED : June 14, 2005
INVENTOR(S) : William L. Walch

It is certified that error appears in the above-identified patent and that said Letters Patent is hereby corrected as shown below:

The Title page and specification consisting of claims 1-40, should be deleted and replaced with the attached title page and specification consisting of new claims 1-40.

Drawing Sheets 1 through 5, should be deleted and replaced with the attached drawing sheets consisting of figures 1-7.

Signed and Sealed this

Twenty-first Day of March, 2006

JON W. DUDAS
*Director of the United States Patent and Trademark Office*

(12) United States Patent
Walch

(10) Patent No.: US 6,905,395 B2
(45) Date of Patent: Jun. 14, 2005

(54) ABRASIVE FLOW MACHINING APPARATUS AND METHOD

(75) Inventor: William L. Walch, Greensburg, PA (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 10/488,527

(22) PCT Filed: Sep. 21, 2001

(86) PCT No.: PCT/US01/42242

§ 371 (c)(1),
(2), (4) Date: Aug. 16, 2004

(87) PCT Pub. No.: WO03/035325

PCT Pub. Date: May 1, 2003

(65) Prior Publication Data

US 2004/0266320 A1 Dec. 30, 2004

(51) Int. Cl.[7] ..... B24B 31/116
(52) U.S. Cl. ..... 451/36; 451/113
(58) Field of Search ..... 451/36, 37, 60, 451/61, 113, 430, 559, 1, 24, 27, 7

(56) References Cited

U.S. PATENT DOCUMENTS

| | | | | | |
|---|---|---|---|---|---|
| 3,634,973 | A | * | 1/1972 | McCarty | 451/36 |
| 3,823,514 | A | * | 7/1974 | Tsuchiya | 451/36 |
| 5,807,163 | A | * | 9/1998 | Perry | 451/36 |

FOREIGN PATENT DOCUMENTS

| | | | | | |
|---|---|---|---|---|---|
| JP | 40-6031615 | * | 2/1994 | | 451/36 |
| JP | 40-3196964 | * | 8/1994 | | 451/36 |

* cited by examiner

*Primary Examiner*—Robert A. Rose
(74) *Attorney, Agent, or Firm*—The Webb Law Firm, P.C.

(57) ABSTRACT

An apparatus and method for abrasive flow machining the orifice (18) of a workpiece (20) by using an abrasive media (15) whereby the apparatus (10) is capable of passing media (15) through the orifice (18) at a predetermined pressure and at a constant flow rate. In the alternative, the apparatus (10) is capable of passing media (15) through the orifice (18) at a fixed flow rate by using variable pressure upon the media (15) through the orifice (18).

40 Claims, 5 Drawing Sheets

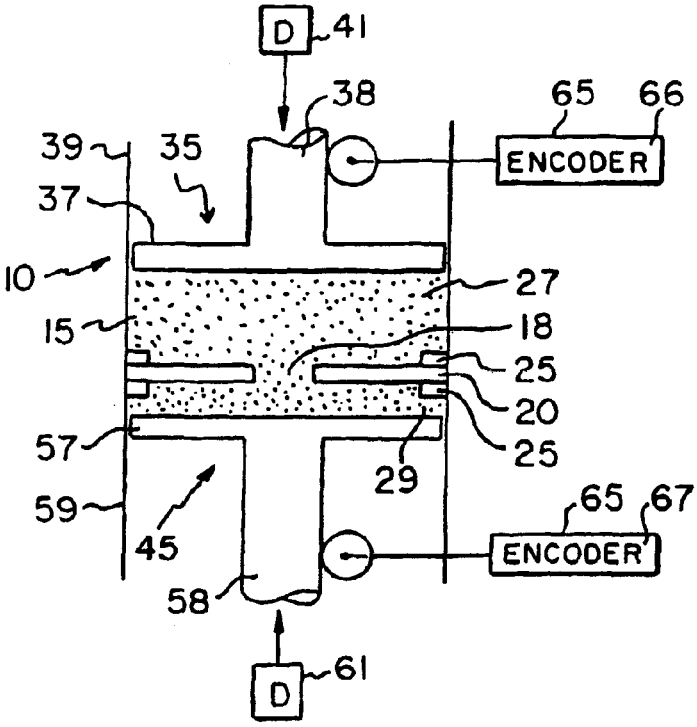

ABRASIVE FLOW MACHINING APPARATUS AND METHOD

BACKGROUND OF THE INVENTION

1. Field of the Invention

The invention is related to abrasive flow machining and, more particularly, to an abrasive flow machining apparatus capable of processing an orifice within a part by carefully controlling the media flow rate. The invention is also directed to a method for such processing.

2. Description of the Related Art

Abrasive flow machining is the process of polishing or abrading a workpiece by passing a viscous media having abrasive particles therein under pressure over the workpiece or through an orifice extending through the workpiece.

Conventional abrasive flow machining processes are designed to maintain a constant media extrusion pressure which often results in significant changes in media temperature, flow rate and viscosity which adversely impacts the system capability to accurately predict abrasive flow machine (AFM) processing times and, consequently, overall process results.

As an example, the media temperature increases as the flow rate of the media increases through an orifice. When the orifice is subjected to media under a constant pressure, the flow rate of the media through the orifice increases as the orifice walls becomes smoother and the orifice diameter increases. As a result, not only does the media temperature increase, but such an increase is localized to the media that passes through the orifice at a higher flow rate. This produces both excessively high temperatures and a non-uniform temperature distribution throughout the media. High temperatures and variations in temperatures throughout the media prevent the media from working in a consistent and effective fashion. Therefore, an apparatus and method that may effectively utilize the media while at the same time maintain the temperature of the media within a relatively narrow temperature band is desired.

U.S. Pat. No. 3,634,973, which is assigned to the assignee of the present invention, discloses a reciprocal machining structure utilizing abrasive media but operating in a fashion which does not provide for direct control of the media flow rate through an orifice. While this apparatus is capable of affective abrasive flow machining, such machining would be of a higher quality and the media would last longer if the flow rate were controlled.

BRIEF SUMMARY OF THE INVENTION

A first embodiment of the subject invention is directed to an abrasive flow machine for moving abrasive media through the orifice of a workpiece comprising a workpiece holder, wherein the holder is adapted to securely retain the workpiece, and wherein one side of the holder defines an upstream side and the other side of the holder defines a downstream side. A first positive displacement pump positioned on the upstream side and connected to the upstream side of the holder for forcing media under a predetermined pressure to the downstream side of the holder. A media opposer is positioned on the downstream side and connected to the downstream side of the holder for opposing the flow of the media to the downstream side, thereby controlling the media flow rate from the upstream side to the downstream side of the holder.

In a second embodiment of the subject invention, an abrasive flow machine for moving abrasive media through the orifice of a workpiece comprises a workpiece holder, wherein the holder is adapted to securely retain the workpiece, and wherein one side of the holder defines a first side and the other side of the holder defines a second side. A first positive displacement pump is positioned on the first side and connected to the first side of the holder and a second positive displacement pump positioned on the second side and connected to the second side of the holder. In a first mode the first positive displacement pump forces media from the first side to the second side of the holder while the second displacement pump resists flow thereby controlling flow to the second side of the holder. In a second mode the second positive displacement pump forces media from the second side to the first side of the holder while the first displacement pump resists flow thereby controlling flow to the first side of the holder.

A third embodiment of the subject invention is directed to a method for abrasive flow machining using an abrasive media through the orifice of a workpiece, wherein the orifice defines an upstream side and a downstream side. The method comprises the steps of moving media through the orifice from the upstream side to the downstream side at a predetermined constant pressure on a first side and selectively throttling the flow of media to the downstream side to control the flow rate of the media passing through the orifice while maintaining the predetermined constant pressure on a second side.

A fourth embodiment of the subject invention is directed to a method for abrasive flow machining using an abrasive media through the orifice of a workpiece, wherein the orifice defines a first side and a second side. The method comprises the steps of moving media through the orifice from the first side to the second side at a predetermined constant pressure selectively throttling the flow of media to the second side to control the flow rate of the media passing through the orifice while maintaining the predetermined constant pressure moving media through the orifice from the second side to the first side at the predetermined constant pressure and selectively throttling the flow of media to the first side to control the flow rate of the media passing through the orifice while maintaining the predetermined constant pressure.

A fifth embodiment of the subject invention is directed to a method for abrasive flow machining using an abrasive media through the orifice of a workpiece, wherein the orifice defines an upstream side and a downstream side, comprising the steps of moving media through the orifice from the upstream side to the downstream side at a pressure adjusting the pressure to provide a constant flow rate of the media passing through the orifice.

A sixth embodiment of the subject invention is directed to a method for abrasive flow machining using an abrasive media through the orifice of a workpiece, wherein the orifice defines a first side and a second side. The method comprises the steps of moving media through the orifice from the first side to the second side by applying pressure at the first side and relieving pressure at the second side, adjusting the pressure at the first side to provide a constant flow rate of the media passing from the first side through the orifice, moving media through the orifice from the second side to the first side by applying pressure at the second side and relieving pressure at the first side, and adjusting the pressure at the second side to provide a constant flow rate of the media passing from the second side through the orifice.

BRIEF DESCRIPTION OF THE DRAWINGS

Figure 2:
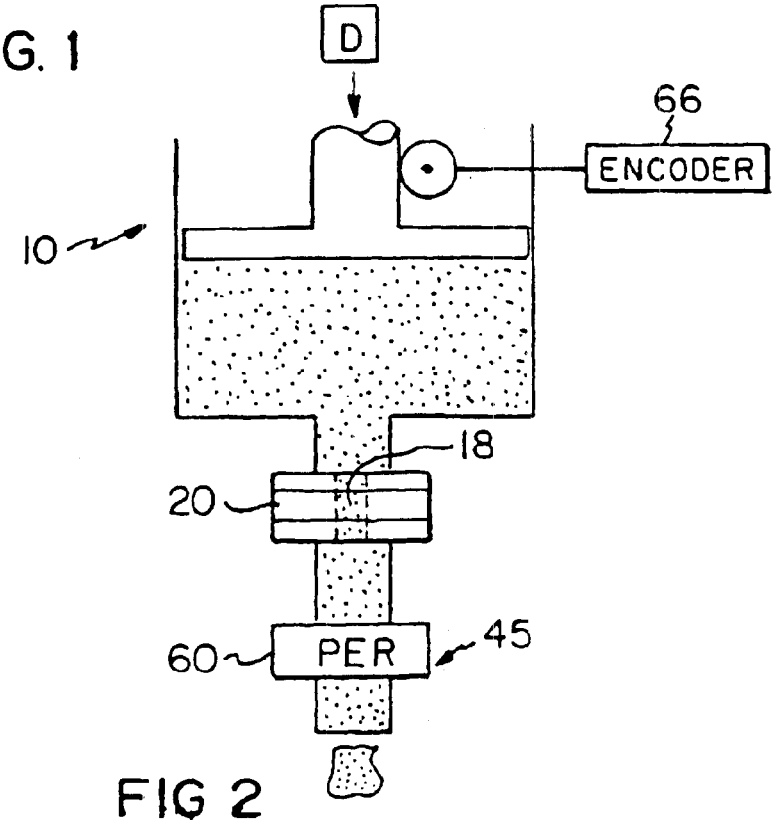
FIG. 2 is a simplified sketch of a single positive displacement pump displacing media through the orifice of a workpiece and opposing the flow of the media thereafter.

FIG. 1 is a simplified sketch illustrating two opposing positive displacement pumps urging abrasive media through the orifice of a workpiece;

FIG. 2 is a simplified sketch of a single positive displacement pump displacing media through the orifice of a workpiece and opposing the flow of the media thereafter;

FIG. 3 illustrates opposing positive displacement pumps for moving media back and forth through an orifice whereby the drivers of the pumps are linear actuators;

FIG. 4 is a simplified sketch of two opposing positive displacement pumps and the control systems which operate them;

FIG. 5 is a sketch of an operating system illustrating two opposing positive displacement pumps and the associated hardware;

FIG. 6 is a simplified sketch of a single positive displacement pump which provides media through an orifice whereby the media is released to an open environment; and FIG. 7 is a perspective view of an in-line heat exchanger that may be used to control the temperature of the media.

DETAILED DESCRIPTION OF THE INVENTION

In one embodiment of the subject invention abrasive media is subjected to a constant pressure and forced through an orifice of a workpiece. The flow rate discussed with this embodiment will be equal to or less than the maximum flow rate capability with the downstream side of the orifice open to the atmosphere. In particular, a flow rate of less than this maximum value is obtained by limiting the flow of the media at the down stream side of the orifice.

Directing attention to FIG. 1, a simplified schematic of an abrasive flow machine 10 for moving abrasive media 15 through the orifice 18 of a workpiece 20 is illustrated. For purposes of this discussion, media will be discussed as having viscosity in the range between 1 to 50 million centipoise. One example of a relatively high viscosity media is a visco-elastic plastic media such as a semisolid polymer composition. One example of a media having a lower viscosity is a liquid abrasive slurry that includes abrasives suspended or slurried in fluid media such as cutting fluids of honing fluids. The fluid may have a rheological additive, and finely divided abrasive particles incorporated therein. The rheological additive creates a thixotropic slurry. The abrasive flow machine 10, as an entity on its own, will not include the workpiece 20 having the orifice 18 therein but will include a workpiece holder 25 which is adapted to securely retain the workpiece 20 wherein one side 27 of the holder 25 defines an upstream or first side and the other side 29 of the holder 25 defines a downstream or second side.

A first positive displacement pump 35 is positioned on the upstream side 27 and connected to the upstream side 27 of the holder 25 for forcing media 15 under a predetermined pressure through the orifice 18 of the workpiece 20 to the downstream side 29 of the holder 25.

Unencumbered flow of the media through the orifice 18 is prevented by a media opposer 45 positioned on the downstream side 29 of the holder 25 for opposing the flow of the media 15 to the downstream side 29, thereby controlling the media flow rate from the upstream side 27 to the downstream side 29 of the holder 25.

As illustrated in FIG. 1, the first positive displacement pump 35 is comprised of a piston 37 within a cylinder 39, wherein the piston 37 is operable to urge media 15 from the cylinder 39 toward the downstream side 29 of the holder 25. The piston 37 is moved by a driver 41. As will be illustrated, the driver 41 for the piston 37 may be a hydraulic actuator (FIG. 4) or as illustrated in FIG. 3, the driver 41 maybe a linear motor actuator 42 which utilizes for example, a worm gear 43 which engages a mating gear 44 on a rod 38 extending from the piston 37. It should be appreciated that while only two types of drivers have been mentioned, any number of drivers known to those skilled in the art of hydraulic machinery may be utilized for the positive displacement pumps in accordance with the subject invention.

Returning to FIG. 1, one method to control both the pressure of the media 15 and the flow rate of the media 15 involves reducing the flow rate through the orifice 18 by restricting the amount of media permitted to travel to the downstream side 29 of the holder 25. In particular, a second positive displacement pump 55 may be utilized as the media opposer 45 to accomplish this. The second positive displacement pump 55 has a piston 57 within a cylinder 59. The piston 57 is operable to resist and thereby control the media flow to the downstream side 29 of the holder 25.

Other mechanisms are available to act as a media opposer 45. Directing attention to FIG. 2, an arrangement similar to that in FIG. 1 is presented, however, the media opposer 45 now takes the form of a relief valve 60. The media 15 flows directly through the relief valve 60 and the release pressure of the relief valve 60 is controlled based upon the desired media flow rate.

In a preferred embodiment, the relief valve 60 is a proportional electric relief valve (PER). A control device monitors the flow rate and decreases a voltage output to the proportional electric relief valve 60 when the actual flow rate is greater than a target flow rate. This causes the relief valve 60 to allow less media 15 to pass through. In the alternative, the voltage output to the valve 60 may be increased which allows more media 15 to pass through when the actual flow rate is less than a target flow rate. Other relief valves described herein may operate in a similar fashion.

To accurately determine the media flow rate, a media flow rate measurement device 65 is utilized. One such device is illustrated in FIG. 1. When the first positive displacement pump 35 is comprised of a piston 37 within a cylinder 39, the piston 37 may have a rod 38. An encoder 66 may be used as the flow rate measurement device 65 to measure the linear motion of the rod 38 to determine the media flow rate. Knowing the volume within the cylinder 39, and the rate of travel of the piston 37, which is provided by the encoder 66, the volume flow rate of the media 15 through the orifice 18 may be used to determine the media flow rate and in turn the controller may adjust the media opposer 45 to increase or decrease the flow rate of the media 15 through the orifice 18.

When the media opposer 45 is comprised of the second positive displacement pump 55, which as previously discussed has a piston 57 within a cylinder 59, the piston 57 has a rod 58 and under such circumstances the media flow measurement device 65 may be an encoder 67 that measures the linear motion of the rod 58 to determine the media flow rate. It should be apparent therefore that the measurement of the media flow rate may occur at either the upstream side 27 or downstream side 29 of the holder 25.

Encoders 66, 67 may each be either a linear encoder or a rotary encoder, both of which are well known to those skilled in the field of measurement equipment.

The discussion so far has been limited to flow of media 15 in a single direction from the upstream side 27 of the holder 25 to the downstream side 29 of the holder 25. In the abrasive flow machine 10 embodiment illustrated in FIG. 2, this is the only manner in which the media 15 may flow through the orifice 18 of the workpiece 20. However, as illustrated in FIG. 1, when the media opposer 45 is a second positive displacement pump 55, the roles of the first displacement pump 35 and second displacement pump 55 may alternate such that in a first mode the first displacement pump 35 may force media 15 through the orifice 18 while the second positive displacement pump 55 acts as the media opposer 45 to control the flow rate of the media 15. In a second mode of operation, the second positive displacement pump 55 may be used to force the media 15 toward the first positive displacement pump 35 while the first positive displacement pump 35 is used as a media opposer to control flow in the opposite direction. It is apparent from this description that with these alternating modes media 15 maybe moved back and forth through the orifice 18 in a reciprocating fashion.

Directing attention once again to FIG. 1, each of the first positive displacement pump 35 and the second positive displacement pump 55 are comprised of pistons 37, 57 within cylinders 39, 59 wherein the pistons 37, 57 are moved by drivers 41, 61. Just as before, each driver 41, 61 may be a hydraulic actuator, which will be described or in the alternative, may be a linear motor actuator as illustrated in FIG. 3.

When the abrasive flow machine 10 is operating such that media 15 is moved only in a single direction through the orifice 18 of the workpiece 20, the media 15 is moved through the orifice 18 from the upstream side 27 to the downstream side 29 at a predetermined constant pressure. The flow of media 15 to the downstream side 29 is then selectively throttled to control the flow rate of the media 15 passing through the orifice 18 while at the same time maintaining the predetermined constant pressure.

In an alternative embodiment when the abrasive flow machine 10 is utilized in a reciprocating fashion, media 15 is moved through the orifice 18 from the upstream side 27, which is now referred to as the first side 27, to the downstream side 29, which is now referred to as the second side 29, at a predetermined constant pressure. The flow of media 15 to the second side 29 is selectively throttled to control the flow rate of the media 15 passing through the orifice 18 while maintaining the predetermined constant pressure. Thereafter, the media 15 is moved through the orifice 18 from the second side 29 to the first side 27 at a predetermined constant pressure. However, the flow of media 15 to the first side 27 is now selectively throttled to control the flow rate of the media 15 passing through the orifice 18 while maintaining the predetermined constant pressure. Just as before, the amount the media selectively throttled is determined by the media flow rate through the orifice 18, and this is determined by monitoring the flow rate utilizing one or both of the linear encoders 66, 67.

FIG. 4 illustrates a more comprehensive schematic view of the abrasive flow machine 10, wherein each positive displacement pumps 35, 55 has a driver 41, 61 and each driver 41, 61 may be a hydraulic actuator.

In particular, FIG. 4 includes many elements previously discussed, and the reference numbers for these elements will be retained. However, additional details associated with the driver 41 and the driver 61 in conjunction with the operation of the abrasive flow machine 10 will now be discussed.

In the single stroke mode, whereby the first positive displacement pump 35 moves media 15 through the orifice 18 of the workpiece 20 to the media opposer 45, which is the second positive displacement pump 55, the driver 41 acts to force the media 15 through the orifice 18 while the driver 61 acts as a media opposer 45 to resist and control such flow. Directing attention to the hydraulic actuator 70 associated with driver 41, a hydraulic pump 72 moves media through a supply line 74 at which point the hydraulic fluid 76 encounters a poppet valve 78, which may be a solenoid operated poppet valve (SOP), which for purposes of our discussion is a valve which permits full flow or no flow. The hydraulic fluid 76 also encounters a proportional electric relief valve 80, which as previously mentioned is capable of adjusting its resistance to flow therethrough. When the hydraulic actuator 70 is being used as a driver 41, the poppet valve 78 is in the full open position and the relief valve 80 is completely closed. Therefore, the hydraulic cylinder 82 is pressurized with hydraulic fluid 76 at whatever pressure the pump 72 can provide. This may be a predetermined pressure that remains constant throughout the stroke of the first positive displacement pump 35. A piston 84 in the hydraulic cylinder 82 is acted upon by the pressurized hydraulic fluid 76 such that, through the common piston rod 38, the piston 37 is advanced against the media 15, thereby forcing the media 15 through the orifice 18 of the workpiece 20.

When the first positive displacement pump 35, with the hydraulic actuator 70, acts as a driver 41, the second positive displacement pump 55, with the hydraulic actuator 90, acts as a media opposer 45. In particular, the hydraulic actuator 90 has similar components to the hydraulic actuator 70 including a hydraulic pump 92, supply line 94, and hydraulic fluid 96, wherein the hydraulic fluid is directed to a poppet valve 98 and a relief valve 100. The hydraulic actuator 90 is further comprised of a hydraulic cylinder 102 having a piston 104 therein connected to the piston rod 58 of the positive displacement pump 55. When the driver 41 urges media 15 through the orifice 18 media 15 is also urged against the piston 57, thereby transferring a force to the piston 104 which acts against the hydraulic fluid 96 in the hydraulic actuator 90. When the second positive displacement pump 55 acts as a media opposer 45 the poppet valve 98 is completely closed such that the hydraulic fluid 96 must pass through the relief valve 100.

It should be noted in FIG. 4 that a single pump utilizing directional valves and a hydraulic fluid reservoir may be used in lieu of the two pumps 72, 92.

The media flow rate through the orifice 18 is determined by one of the encoders 66, 67 and transmitted to a controller. Utilizing the media flow rate, and comparing it to a target media flow rate, the voltage in the proportional electric relief valve 100 is adjusted to permit hydraulic fluid 96 past the relief valve 100 in such a manner that the retraction of the piston 104 is controlled, thereby controlling the media flow rate. In this manner, when the first positive displacement pump 35 acts as the driver 41, the poppet valve 78 associated with the hydraulic actuator 70 is fully opened thereby bypassing the relief valve 80. With respect to the hydraulic actuator 90 of the second positive displacement pump 55, the poppet valve 78 is fully closed thereby forcing hydraulic fluid 96 through the relief valve 100, which throttles the hydraulic fluid flow to control the media flow rate.

In the second mode the same configuration exists, but in a reversed arrangement. In particular, when the second positive displacement pump 55 acts as a driver 61, the first positive displacement pump 35 acts as a media opposer. In particular, in this configuration the poppet valve 98 is fully opened such that the full pressure produced upon the hydraulic fluid 96 by the pump 92 is transferred to the piston 104, which in turn acts upon the piston 57 through the piston rod 58 and forces the media 15 through the orifice 18 toward the first positive displacement pump 35. Acting as a media opposer, the hydraulic actuator 70 is configured such that the poppet valve 78 is fully closed thereby forcing the hydraulic fluid 76 through the relief valve 80. The release pressure of the relief valve 80 may be electronically controlled by the controller based upon the media flow rate determined by one of the encoders 66, 67. In this fashion, the operation of the abrasive flow machine may be alternated between the first mode and the second mode to provide a reciprocating motion of the media 15 through the orifice 18 of the workpiece 20.

FIG. 5 represents a sketch of the hardware utilized to implement at least one embodiment of the subject invention described hereto. Just as before, like reference numerals are repeated. However, some additional elements are illustrated in this drawing. In particular, there is a pressure sensor 105 in the form of a pressure transducer associated with the hydraulic supply line 74 to determine the pressure in that line. Additionally, there is a pressure sensor 108 associated with supply line 94 to determine pressure in that line. It should be appreciated the pressure in the supply lines 74, 94 will be transmitted to the media 15 by the respective pistons 37, 57. Additionally, a temperature sensor 110 may be utilized to determine the temperature of the media 15.

The pressure of the hydraulic fluid, which translates into the pressure of the media 15, along with the linear position of each piston 37, 57 is processed by a controller 112 which in turn acts to modify the release pressure of the pressure relief valve 80 for the positive displacement pump acting as the media opposer.

By more closely controlling the flow rate of the media 15 through the orifice 18, the temperature may be held within a relatively narrow temperature band in contrast to when the flow rate is not controlled. Nevertheless, it may still be desirable to remove heat from the media 15 during the abrasive flow machining process. For that reason there may be a cooling collar 115 associated with the first positive displacement pump cylinder 39 and a cooling collar 117 associated with the second positive displacement pump cylinder 59. Each of these cooling collars 115, 117 may have a plurality of cooling tubes 116, 118 capable of transferring heat from the media 15 when necessary. Under certain circumstances these cooling collars 115, 117 may also be utilized to heat the media 15 such as, for example, when the media 15 must begin the abrasive process at a minimum temperature. The cooling collars 115, 117 are externally positioned and do not interfere with the flow of media 15. However, their effectiveness is limited because heat transfers from the media 15 to the collars 115, 117 occurs by conduction through the walls of the cylinders 39, 59.

It is possible to introduce an in-line heat exchanger directly within the flow path of the media 15. FIG. 7 illustrates one such heat exchanger 200 having hollow cooling fins 202 within an internal passageway 205 through which the media 15 flows. Coolant passes through a coolant inlet 207, enters the hollow fins 202 and exits at the coolant outlet (not shown). Bolts may extend through peripheral holes 209 in the collar 210 to secure the heat exchanger 200. The heat exchanger 200 may be attached to one or both cylinders 39, 59 and may be adjacent to the holder 25. While this heat exchanger 200 provides a greater heat transfer rate with the media 15, it also partially obstructs the flow of media 15 such that the cylinder size may need to be increased to accommodate a given flow rate.

The controller 112 (FIG. 5) may be a programmable logic controller such as the Micologics 1200 model, which is commercially available from the Allen Bradley Company. Additionally, the proportional electric relief valve may be type TS 10-26, which is commercially available from Hydra Force, Inc. Additionally, the poppet valves may be type SV 10-23 two way normally open valves commercially available from Hydro Force, Inc.

The signals from the encoders 66, 67 are used by the controller 112 to calculate the actual flow rate of the media 15. A suitable encoder is the Quadrature type, which is commercially available from Automation Direct, Inc. The use of the encoders 66, 67 and the poppet valves 78, 98 and the relief valves 80, 100 allow the controller 112 to maintain a desired consistent media flow rate. This consistent flow rate allows the media to remain within a narrow temperature band, as measured by the temperature sensor 110, which in turn maintains consistent media viscosity. By maintaining the media viscosity essentially constant, the controller 112 may more accurately predict the processing time to achieve the desired machining of the orifice 18.

What has so far been described are drivers 41, 61 which alternately urge media 15 under constant pressure through the orifice 18 of the workpiece 20 while the flow rate of the media 15 is controlled by the retraction or resistance of the media opposer 50 which may be a pressure relief valve or the other driver.

It is possible to eliminate the media opposer 45 and still maintain a constant media flow rate. This is accomplished by varying the pressure provided by the driver 41 to the media 15. As the abrasive flow machining process proceeds, given a constant media pressure, the flow rate of the media 15 through the orifice 18 tends to increase. Therefore, to maintain the same media flow rate, it is necessary to decrease the pressure imparted to the media 15 by the driver 41. This may be accomplished in a single direction, or just as before, in a reciprocating motion.

Directing attention to FIG. 6, in a single direction media 15 is moved through the orifice 18 from the upstream side 27 to the downstream side 29 at a particular pressure. Utilizing encoder 66 the flow rate may be monitored and the pressure provided to the media may be adjusted to provide a constant flow rate of the media 15 passing through the orifice 18. In particular, the encoder 66 may monitor the linear motion of the piston rod 38 associated with piston 37 to determine the flow rate. The pump 72 delivers hydraulic fluid under pressure to the hydraulic cylinder 82, where the fluid acts upon the hydraulic piston 84. With respect to the arrangement illustrated in FIG. 4, it is entirely possible for the downstream side 29 of the holder 25 to discharge into the atmosphere as illustrated in FIG. 6. In the alternative, and again directing attention to FIG. 4, it is possible to coordinate the motion of piston 37 with that of piston 57 such that the flow of media 15 applied under pressure at the first side 27 through the orifice 18 is neither hindered nor assisted by piston 57 but that pressure on the second side 29 side is relieved. It is also possible to coordinate the motion of piston 57 with that of piston 37 such that the flow of media 15 applied under pressure at the second side 57 through the orifice 18 is neither hindered nor assisted by piston 37 but that pressure on the first side 37 is relieved. Such an arrangement will permit the abrasive flow machine 10 illustrated in FIG. 4 to operate in a reciprocating fashion whereby in a first mode that the first positive displacement pump 35 forces the media 15 though the orifice 18 while the second positive displacement pump 55 is passive, and in the second mode the second positive displacement pump 55 forces the media 15 through the orifice 18 while the first positive displacement 35 is passive.

The invention has been described with reference to the preferred embodiments. Various modifications and alterations will occur upon reading and understanding the preceding detailed description. It is intended that the invention be construed as including all such modifications and alterations insofar as they come within the scope of the appended claims or the equivalents thereof.

We claim:

1. An abrasive flow machine for moving abrasive media through the orifice of a workpiece comprising:

a) a workpiece holder, wherein the holder is adapted to securely retain the workpiece, and wherein one side of the holder defines an upstream side and the other side of the holder defines a downstream side;

b) a first positive displacement pump positioned on the upstream side and connected to the upstream side of the holder for forcing media under a predetermined pressure to the downstream side of the holder;

c) a media opposer positioned on the downstream side and connected to the downstream side of the holder for opposing the flow of the media to the downstream side;

d) a media flow rate measurement device to determine flow rate of media past the holder; and e) a controller for controlling the media opposer to limit the media flow to a predetermined flow rate from the upstream side to the downstream side of the holder while the first positive displacement pump maintains the predetermined upstream pressure.

2. The flow machine according to claim 1 wherein the first positive displacement pump is a piston within a cylinder, wherein the piston is operable to urge media from the cylinder toward the downstream side of the holder and wherein the piston is moved by a driver.

3. The flow machine according to claim 2 wherein the driver is a hydraulic actuator.

4. The flow machine according to claim 2 wherein the driver is a linear motor actuator.

5. The flow machine according to claim 1 wherein the media opposer is a relief valve.

6. The flow machine according to claim 5 wherein the media opposer is a proportional electric relief valve.

7. The flow machine according to claim 1 wherein the media opposer is a second positive displacement pump.

8. The flow machine according to claim 7 wherein the second positive displacement pump is a piston within a cylinder, wherein the piston is operable to resist and thereby control the media flow to the downstream side of the holder.

9. The flow machine according to claim 1 wherein the first positive displacement pump is comprised of a piston within a cylinder, wherein the piston has a rod and wherein an encoder measures the linear motion of the rod to determine the media flow rate.

10. The flow machine according to claim 1 wherein the media opposer is a second positive displacement pump comprised of a piston within a cylinder, wherein the piston has a rod and wherein the media flow rate measurement device is an encoder that measures the linear motion of the rod to determine the media flow rate.

11. The flow machine according to claim 1 further including a cooler for the media.

12. The flow machine according to claim 11 wherein the cooler is comprised of cooling collars around at least one of the first positive displacement pump cylinder and the second positive displacement pump cylinder.

13. The flow machine according to claim 11 wherein the cooler is comprised of an in-line heat exchanger adjacent to the holder in at least one of the first displacement pump cylinder and the second displacement pump cylinder.

14. An abrasive flow machine for moving abrasive media through the orifice of a workpiece comprising:

a) a workpiece holder, wherein the holder is adapted to securely retain the workpiece, and wherein one side of the holder defines a first side and the other side of the holder defines a second side;

b) a first positive displacement pump positioned on the first side and connected to the first side of the holder;

c) a second positive displacement pump positioned on the second side and connected to the second side of the holder;

d) wherein in a first mode the first positive displacement pump forces media from the first side to the second side of the holder while the second displacement pump resists flow thereby controlling flow to the second side of the holder;

e) wherein in a second mode the second positive displacement pump forces media from the second side to the first side of the holder while the first displacement pump resists flow thereby controlling flow to the first side of the holder;

f) a media flow rate measurement device to determine the flow rate of media past the holder; and g) a controller for controlling the first positive displacement pump and the second positive displacement pump to limit the media flow to a predetermined flow rate as it travels back and forth past the holder.

15. The abrasive flow machine according to claim 14 wherein the each the first and second positive displacement pumps are comprised of pistons within cylinder wherein the pistons are moved by drivers.

16. The flow machine according to claim 15 wherein at least one driver is a hydraulic actuator.

17. The flow machine according to claim 15 wherein at least one driver is a linear motor actuator.

18. The flow machine according to claim 14 wherein the each of the first positive displacement pump and the second displacement pump have a rod associated within their respective pistons and wherein the media flow rate measurement device is an encoder that measures the linear motion of at least one rod to determine the media flow rate.

19. The flow machine according to claim 14 further including a cooler for the media.

20. The flow machine according to claim 19 wherein the cooler is comprised of cooling collars around at least one of the first positive displacement pump cylinder and the second positive displacement pump cylinder.

21. The flow machine according to claim 19 wherein the cooler is comprised of an in-line heat exchanger adjacent to the holder in at least one of the first displacement pump and the second displacement pump cylinders.

22. A method for abrasive flow machining using an abrasive media through the orifice of a workpiece, wherein the orifice defines an upstream side and a downstream side, comprising the steps of:

a) moving media through the orifice from the upstream side to the downstream side at a predetermined constant pressure on the upstream side;

b) monitoring the flow rate; and c) selectively throttling the flow of media to the downstream side to control the flow rate of the media passing through the orifice while maintaining the predetermined constant pressure on the upstream side.

23. The method according to claim 22 wherein media is forced through the orifice using a first positive displacement pump comprised of a piston with a piston rod wherein the piston is within a cylinder and moved by a driver connected to the piston and wherein the step monitoring flow rate is accomplished by monitoring the linear movement of the piston rod.

24. The method according to claim 22 further comprising the step of restricting the media flow downstream to control the media flow rate.

25. The method according to claim 24 wherein the step of throttling is accomplished using a proportional electric relief valve to resist downstream flow of the media.

26. The method according to claim 24 wherein the step of throttling is accomplished using a second positive displacement pump to resist downstream flow of the media.

27. The method according to claim 22 further including the step of cooling the media.

28. A method for abrasive flow machining using an abrasive media through the orifice of a workpiece, wherein the orifice defines a first side and a second side, comprising the steps of:

a) moving media through the orifice from the first side to the second side at a predetermined constant pressure on the first side;

b) monitoring the flow of media through the orifice;

c) selectively throttling the flow of media to the second side to control the flow rate of the media passing through the orifice while maintaining the predetermined constant pressure on the first side;

d) moving media through the orifice from the second side to the first side at the predetermined constant pressure on the second side; and e) selectively throttling the flow of media to the first side to control the flow rate of the media passing through the orifice while maintaining the predetermined constant pressure on the second side.

29. The method according to claim 28 wherein media is forced in one direction through the orifice using a first positive displacement pump comprised of a piston within a cylinder, wherein the piston has a piston rod and wherein the step monitoring the flow rate is accomplished by monitoring the linear movement of the piston rod.

30. The method according to claim 28 wherein the step of throttling is accomplished using a proportional electric relief valve to resist flow of the media from the first side to the second side.

31. The method according to claim 28 wherein the step of throttling is accomplished using a second positive displacement pump to resist flow of the media from the first side to the second side.

32. The method according to claim 28 further including the step of cooling the media.

33. A method for abrasive flow machining using an abrasive media through the orifice of a workpiece, wherein the orifice defines an upstream side and a downstream side, comprising the steps of:

a) moving media through the orifice from the upstream side to the downstream side at a pressure on the upstream side;

b) monitoring the flow rate of media through the orifice and c) adjusting the pressure on the upstream side to provide a constant flow rate of the media passing through the orifice.

34. The method according to claim 33 further including the step of monitoring the flow rate.

35. The method according to claim 34 wherein media is forced through the orifice using a first positive displacement pump comprised of a piston with a piston rod wherein the piston is within a cylinder and moved by a driver connected to the piston and wherein the step monitoring flow rate is accomplished by monitoring the linear movement of the piston rod.

36. The method according to claim 33 further including the step of cooling the media.

37. A method for abrasive flow machining using an abrasive media through the orifice of a workpiece, wherein the orifice defines a first side and a second side, comprising the steps of:

a) moving media through the orifice from the first side to the second side by applying pressure at a first side and relieving pressure at the second side;

b) monitoring the flow rate of media through the orifice;

c) adjusting the pressure at the first side to provide a constant flow rate of the media passing from the first side through the orifice;

d) moving media through the orifice from the second side to the first side by applying pressure at the second side and relieving pressure at the first side; and e) adjusting the pressure at the second side to provide a constant flow rate of the media passing from the second side through the orifice.

38. The method according to claim 37 wherein media is forced in one direction through the orifice using a first positive displacement pump comprised of a piston within a cylinder, wherein the piston has a piston rod and wherein the step monitoring the flow rate is accomplished by monitoring the linear movement of the piston rod.

39. The method according to claim 37 wherein the step of throttling is accomplished using a second positive displacement pump to resist flow of the media from the first side to the second side.

40. The method according to claim 37 further including the step of cooling the media.

* * * * *

UNITED STATES PATENT AND TRADEMARK OFFICE

CERTIFICATE OF CORRECTION

PATENT NO. : 6,905,395 B2
DATED : June 14, 2005
INVENTOR(S) : Walch

It is certified that error appears in the above-identified patent and that said Letters Patent is hereby corrected as shown below:

Column 12,
Lines 16-46, should be deleted.

Signed and Sealed this

Twenty-third Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,905,395 B2
APPLICATION NO. : 10/488527
DATED : June 14, 2005
INVENTOR(S) : William L. Walch It is certified that error appears in the above-identified patent and that said Letters Patent is hereby corrected as shown below:

This certificate supersedes Certificate of Correction issued May 23, 2006. The Certificate of Correction is to be vacated since corrections to Column 12, line 16-46 were incorporated in the Certificate of Correction issued on March 21, 2006.

Signed and Sealed this

Fourteenth Day of August, 2007

JON W. DUDAS
*Director of the United States Patent and Trademark Office*